US011666787B2

(12) United States Patent
Kim et al.

(10) Patent No.: US 11,666,787 B2
(45) Date of Patent: Jun. 6, 2023

(54) MASK APPARATUS

(71) Applicant: LG ELECTRONICS INC., Seoul (KR)

(72) Inventors: Youngjun Kim, Seoul (KR); Nameun Cho, Seoul (KR); Haeyoong Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 780 days.

(21) Appl. No.: 16/671,777

(22) Filed: Nov. 1, 2019

(65) Prior Publication Data

US 2020/0206545 A1 Jul. 2, 2020

(30) Foreign Application Priority Data

Dec. 26, 2018 (KR) ..... 10-2018-0169576
Jan. 9, 2019 (KR) ..... 10-2019-0002764
Jul. 23, 2019 (KR) ..... 10-2019-0089133

(51) Int. Cl.
*A62B 23/02* (2006.01)
*A62B 18/08* (2006.01)
(Continued)

(52) U.S. Cl.
CPC ..... *A62B 23/025* (2013.01); *A62B 7/10* (2013.01); *A62B 9/04* (2013.01); *A62B 18/006* (2013.01);
(Continued)

(58) Field of Classification Search
CPC ..... A62B 9/04; A62B 18/006; A62B 18/02; A62B 18/025; A62B 18/08; A62B 23/05;
(Continued)

(56) References Cited

U.S. PATENT DOCUMENTS 6,318,369 B1 * 11/2001 Gregory ..... A62B 18/08 128/857
6,550,479 B1 4/2003 Duxbury
(Continued)

FOREIGN PATENT DOCUMENTS

CN 1509780 A 7/2004
CN 2720466 Y 8/2005
(Continued)

OTHER PUBLICATIONS

English translation for CN 107929969, translated on Jul. 27, 2022, translated by espacenet.com.*
(Continued)

*Primary Examiner* — Tu A Vo
(74) *Attorney, Agent, or Firm* — Dentons US LLP

(57) ABSTRACT

A mask device includes a mask body provided with at least one inlet and at least one outlet located below the inlet, a first air cleaner and a second air cleaner for filtering outside air sucked in from an outside environment and supplying the filtered air through the mask body to the inlet, the first air cleaner coupled to one side of the mask body and the second air cleaner coupled to an other side of the mask body, and a first fixing part and a second fixing part, the first fixing part for coupling the first air cleaner to the mask body and the second fixing part for coupling the second air cleaner to the mask body.

18 Claims, 20 Drawing Sheets

(51) Int. Cl.

| | |
|---|---|
| ***A62B 7/10*** | (2006.01) |
| ***A62B 9/04*** | (2006.01) |
| ***A62B 18/02*** | (2006.01) |
| ***A62B 18/00*** | (2006.01) |

(52) U.S. Cl.
CPC ..... *A62B 18/025* (2013.01); *A62B 18/084* (2013.01); *A62B 23/02* (2013.01)

(58) Field of Classification Search
CPC .... A62B 7/08; A62B 7/10; A41D 13/11–1192
See application file for complete search history.

(56) References Cited

U.S. PATENT DOCUMENTS

| | | | | |
|---|---|---|---|---|
| 2004/0003810 | A1* | 1/2004 | Templeton | A62B 17/04 128/201.25 |
| 2004/0079373 | A1 | 4/2004 | Mukaiyama et al. | |
| 2004/0226563 | A1 | 11/2004 | Xu et al. | |
| 2012/0174922 | A1* | 7/2012 | Virr | A61M 16/106 128/206.28 |
| 2018/0185677 | A1* | 7/2018 | Curran | A62B 9/02 |
| 2018/0296864 | A1* | 10/2018 | Feasey | A62B 18/003 |

FOREIGN PATENT DOCUMENTS

| | | | | |
|---|---|---|---|---|
| CN | 101971077 | A | | 2/2011 |
| CN | 204182039 | U | | 3/2015 |
| CN | 104857648 | A | | 8/2015 |
| CN | 105617565 | A | | 6/2016 |
| CN | 105722557 | A | | 6/2016 |
| CN | 107149182 | A | | 9/2017 |
| CN | 107308564 | A | * | 11/2017 |
| CN | 107822232 | A | * | 3/2018 |
| CN | 107847824 | A | | 3/2018 |
| CN | 107929969 | A | * | 4/2018 |
| CN | 107929969 | A | | 4/2018 |
| CN | 107961456 | A | | 4/2018 |
| CN | 108367181 | A | | 8/2018 |
| EP | 3398657 | A1 | | 11/2018 |
| JP | 2016-87376 | A | | 5/2016 |
| KR | 20020025908 | A | | 4/2002 |
| KR | 2004229420000 | Y1 | | 8/2006 |
| KR | 101783804 | B1 | * | 9/2007 |
| KR | 101783804 | B1 | | 10/2017 |
| KR | 20170111132 | A | * | 10/2017 |
| WO | 2017004313 | A1 | | 1/2017 |
| WO | 2017065620 | A1 | | 4/2017 |
| WO | WO-2017188792 | A1 | * | 11/2017 ..... A41D 13/11 |

OTHER PUBLICATIONS

English translation for KR 101783804, translated on Jul. 29, 2022, translated by clarivate analytics of Search engine.*
English translation for KR 20170111132, translated on Jul. 29, 2022, translated by clarivate analytics of Search engine.*
English translation for CN 107822232, machine translated by Search Clarivate Analytics, translated on Jan. 12, 2023.*
English translation for CN 107308564, machine translated by Search Clarivate Analytics, translated on Jan. 12, 2023.*

* cited by examiner

MASK APPARATUS

CROSS-REFERENCE TO RELATED APPLICATIONS

This application claims the benefit of priority to Korean Patent Application Nos. 10-2018-0169576 filed on Dec. 26, 2018; 10-2019-0002764 filed on Jan. 9, 2019; and 10-2019-0089133 filed on Jul. 23, 2019 with the Korean Intellectual Property Office, the entire contents of which are incorporated herein by reference.

FIELD OF THE DISCLOSURE

The present disclosure relates to a mask device.

BACKGROUND

In general, a mask refers to a device for covering a user's nose and mouth to prevent inhalation of germs, dust, and the like. The mask adheres to the user's face to cover the user's nose and mouth. The mask filters germs, dust, and the like contained in the air flowing into the user's nose and mouth, and allows the user to breath in filtered air. Germs, dust, and the like contained in the air pass through the body of the mask that includes a filter, and the germs, dust and the like are filtered by the body of the mask.

However, after passing through the body of the mask, the air may flow into the user's nose and mouth, or the air may flow out of the mask, and thus the user's breathing may not be smooth. Recently, in order to solve the above-mentioned problems, a mask having a motor, a fan, and a filter has been developed.

An example of the mask may be found in Korean Utility Model Registration No. 20-0422942. The mask includes a filter for filtering foreign substances and a fan and a motor for forcibly flowing the air passing through the filter.

Another example of the mask, called a sports mask, may be found in Japanese Patent Laid-Open No. 2016-087376. The mask is provided with a fan for forcibly flowing the filtered air in front of the user's nose and mouth, and a hinge is further provided in the center of the mask to fold the mask.

SUMMARY

One aspect is to provide a mask device including a plurality of air cleaners on both sides of the mask body to increase the flow rate of air supplied to the mask body by the plurality of air cleaners.

Another aspect is to separate the space in which the filtered air flows and the space in which a plurality of parts are accommodated, thereby preventing the air heated by the plurality of parts from flowing back to the space in which the filtered air flows.

Another aspect is to arrange the plurality of air cleaners and the plurality of parts on both sides of the mask body, thereby providing for an evenly balanced mask device.

Another aspect is to improve the structural safety of the mask device by improving the fixing structure so that the plurality of air cleaners supplying the filtered air are firmly fixed to a plurality of fixing parts.

Another aspect is to provide a plurality of air cleaners and a plurality of catching portions that may be mounted and detached on the mask body, so that the maintenance work of the mask device may be made easy.

Another aspect is to provide a duct through which the air filtered by the air cleaner passes and a duct insertion hole into which the duct may be inserted, and thus filtered air may be supplied to the mask body without leakage.

The disclosure describes a mask device that includes a mask body provided with at least one inlet and at least one outlet located below the inlet, a first air cleaner and a second air cleaner for filtering outside air sucked in from an outside environment and supplying the filtered air through the mask body to the inlet, the first air cleaner coupled to one side of the mask body and the second air cleaner coupled to an other side of the mask body, and a first fixing part and a second fixing part, the first fixing part for coupling the first air cleaner to the mask body and the second fixing part for coupling the second air cleaner to the mask body.

DETAILED DESCRIPTION OF THE PREFERRED EMBODIMENTS

Figure 1:
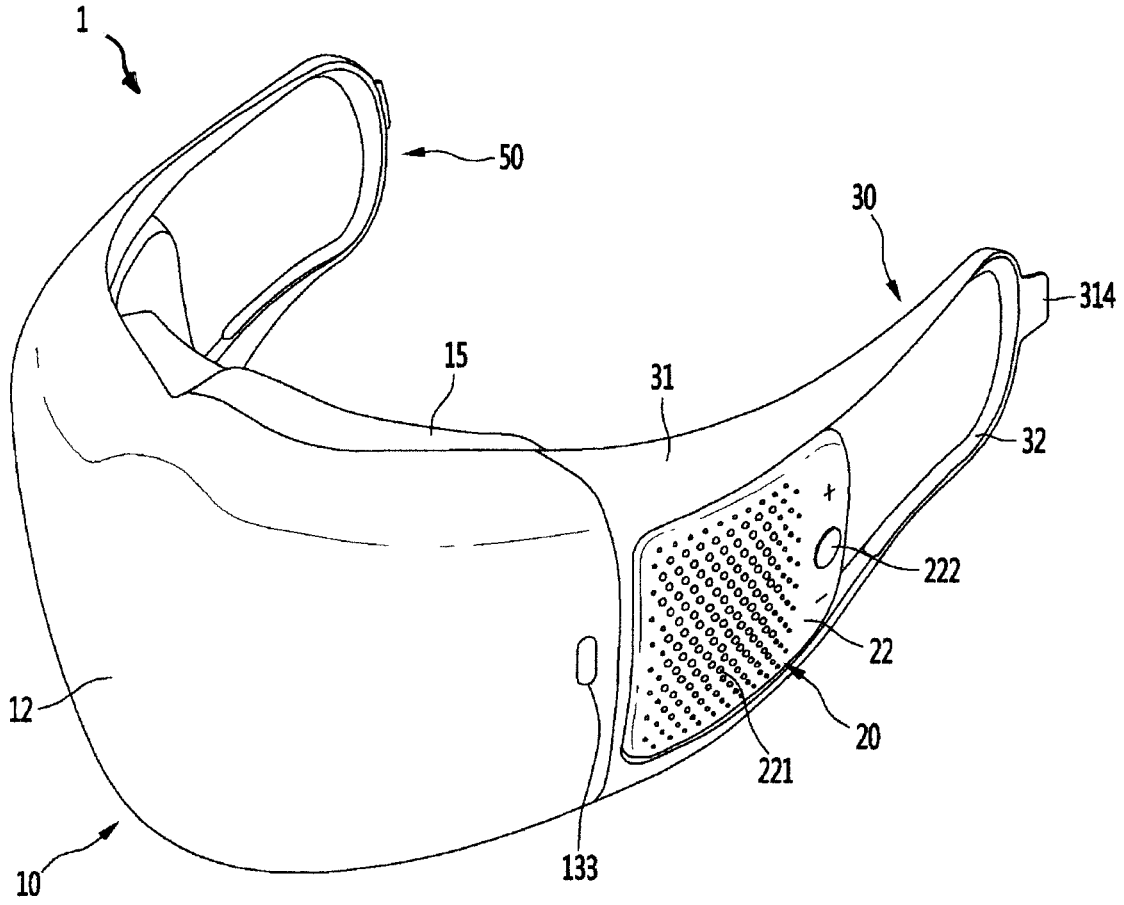
FIG. 1 is a left side perspective view of a mask device according to a first embodiment of the present invention.

Hereinafter, preferred embodiments of the present invention will be described in detail with reference to the accompanying drawings. In adding reference numerals to the components of the drawings, it should be noted that the same reference numerals may be used even though they are shown in different drawings. In addition, in describing the embodiments of the present invention, when it is determined that a detailed description of the well-known configuration or function interferes with the understanding of the embodiments of the present invention, the detailed description thereof may be omitted.

In addition, in describing the components of the embodiment of the present invention, terms such as first, second, A, B, (a), and (b) may be used. These terms are only for distinguishing the components from other components, and the nature, order or order of the components are not limited by the terms. If a component is described as being "connected", "coupled" or "connected" to another component, it should be understood that the component may be directly connected or connected to that other component, but having other components there between.

Figure 2:
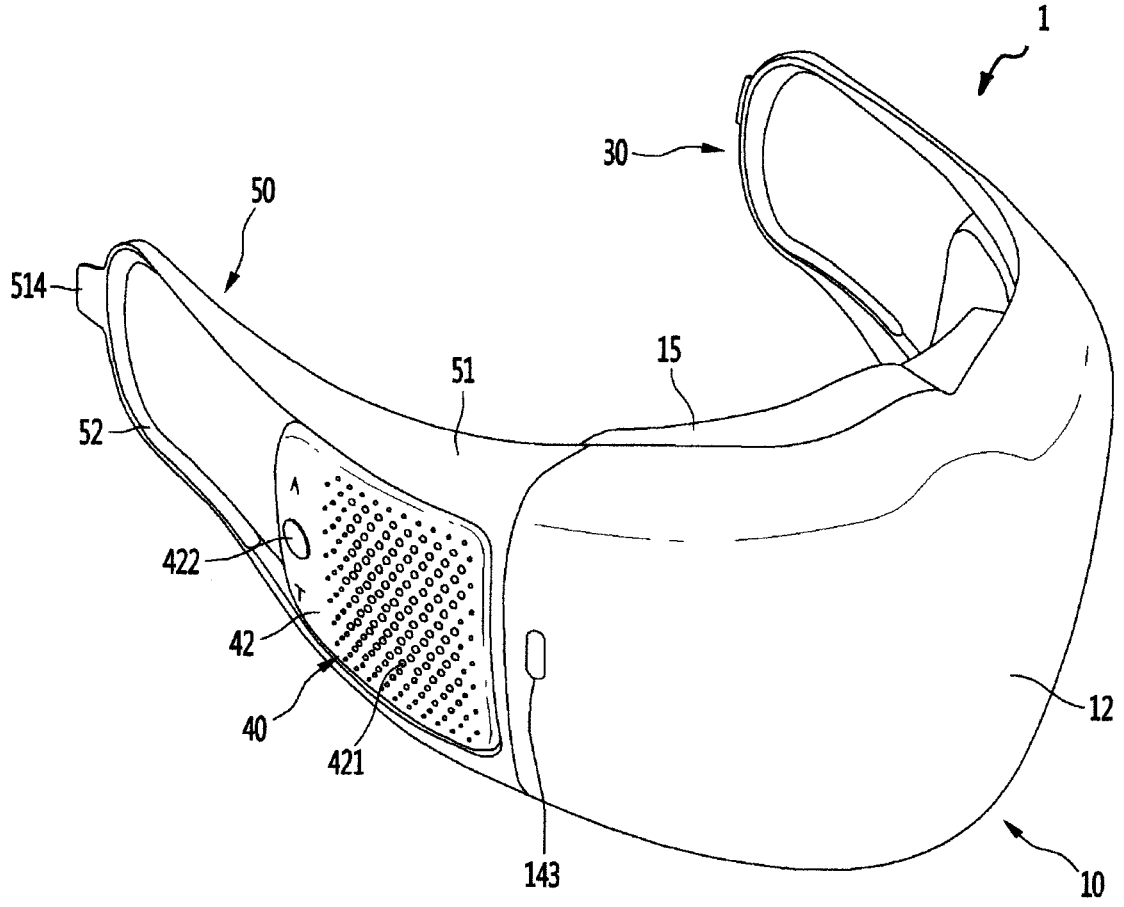
FIG. 2 is a right side perspective view of the mask device according to the first embodiment of the present invention.
Figure 3:
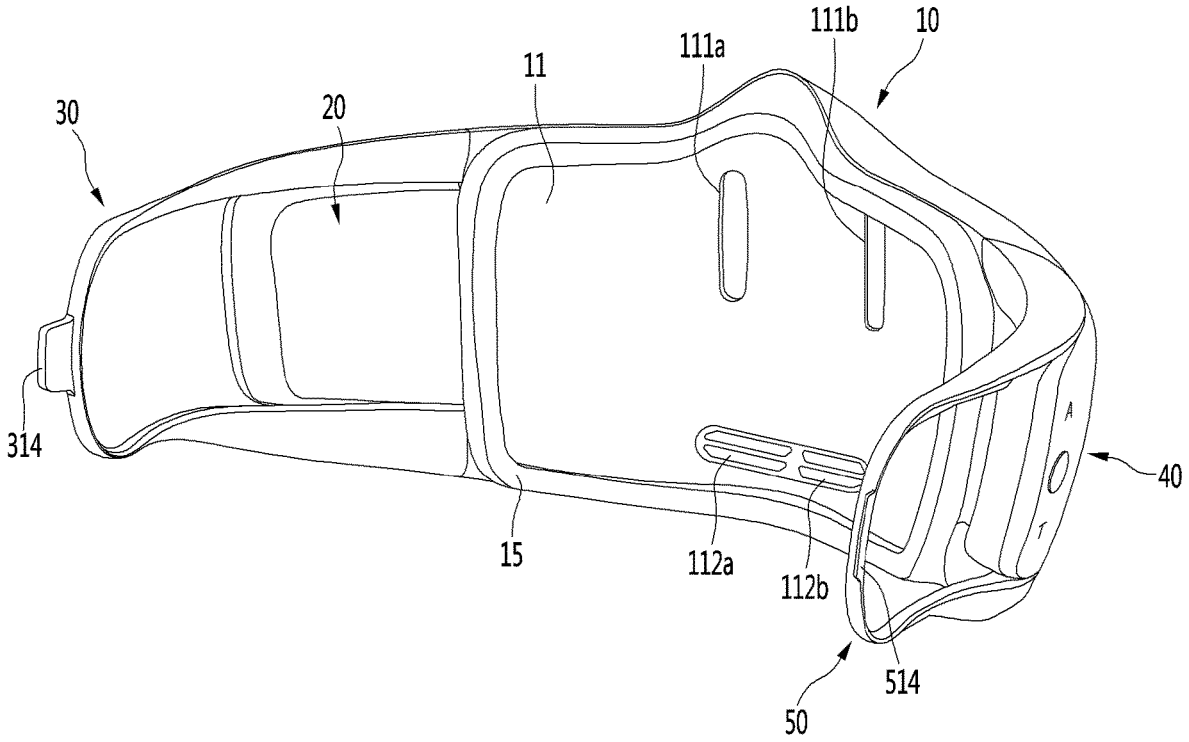
FIG. 3 is a rear side perspective view of the mask device according to the first embodiment of the present invention.
Figure 4:
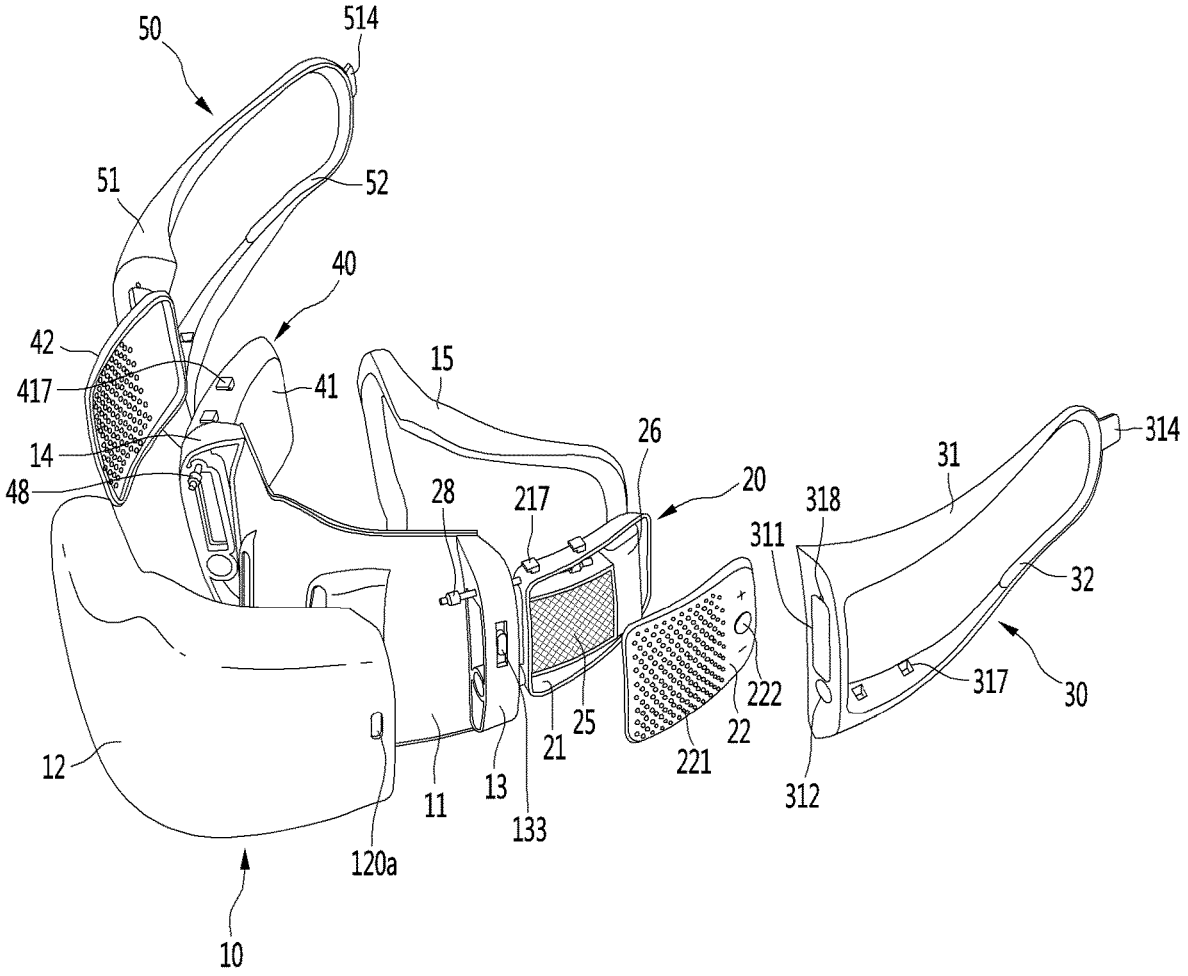
FIG. 4 is a frontal exploded view of the mask device according to the first embodiment of the present invention.

FIG. 1 is a left side perspective view of a mask device according to a first embodiment of the present invention, FIG. 2 is a right side perspective view of the mask device according to the first embodiment of the present invention, FIG. 3 is a rear side perspective view of the mask device according to the first embodiment of the present invention, and FIG. 4 is a frontal exploded view of the mask device according the first embodiment of the present invention.

Referring to FIGS. 1 to 4, the mask device 1 according to the embodiment may include a mask body 10. The mask body 10 may be in close contact with a face of a user. When the mask body 10 is in close contact with the user's face, the mask body 10 may cover the user's mouth and nose.

The mask body 10 may include a frame 11 and a front cover 12. The frame 11 and the front cover 12 may be detachably coupled to each other. The frame 11 may be located in front of the user's nose and mouth, and may define a breathing space for receiving filtered air between the frame 11 and the user's nose and mouth. The front cover 12 may be positioned in a direction toward the outside environment and may form an outer appearance of the mask body 10. A flow path through which air is supplied to the breathing space passes may be formed between the front cover 12 and the frame 11. Air passing through the flow path formed between the front cover 12 and the frame 11 may enter the breathing space. In the present embodiment, the frame 11 may be referred to as a rear cover corresponding to the front cover 12. In addition, when the front cover 12 is referred to as one side cover, first cover, front side, one side, etc., the frame 11 may be referred to as the other side cover, the second cover, the rear side, the other side, etc.

The frame 11 may include an inlet 111*a* and 111*b*, and an outlet 112*a* and 112*b*. The inlet 111*a* and 112*b* may be an opening that supplies air filtered from a first air cleaner 20 and a second air cleaner 40 in the direction toward the user's nose and mouth. The outlet 112*a* and 112*b* may be an opening for discharging air discharged from the user's nose and mouth to the outside environment. The inlet 111*a* and 111*b* may be located in front of the user's nose and the outlet 112*a* and 112*b* may be located in front of the user's mouth. The inlet 111*a* and 111*b* may be formed with an opening larger than the outlet 112*a* and 112*b* to facilitate the inflow of filtered air. When the inlet 111*a* and 111*b* is located in front of the user's nose, the filtered air may be quickly supplied to the user's nose. When the outlet 112*a* and 112*b* is located in front of the user's mouth, the air discharged from the user's mouth and the air discharged from the user's nose may be quickly discharged through the outlet 112*a* and 112*b*. The air flowing from the mask body 10 toward the inlet 111*a* and 111*b*, and the air discharged from the outlet 112*a* and 112*b* to the outside environment may flow in a state separated from each other vertically in the breathing space. Further description of the mask body 10 will be described with respect to FIG. 5.

The mask body 10 may include a first fixing part 13 and a second fixing part 14. The first fixing part 13 and the second fixing part 14 may allow the first air cleaner 20 and the second air cleaner 40 to be fixed to the mask body 10. In the present embodiment, the first fixing part 13 may be disposed on one side of the mask body 10, and the second fixing part 14 may be disposed on the other side of the mask body 10. The one side of the mask body 10 may be defined as a left end of the mask device 1 and the other side of the mask body 10 may be defined as the right end of the mask device 1.

The first fixing part 13 and the second fixing part 14 may be fixed between the front cover 12 and the frame 11. When the front cover 12 and the frame 11 are coupled to each other, insertion space may be formed at the left and right ends of the mask body 10 in which the first fixing part 13 and the second fixing part 14 may be inserted and fixed. The first fixing part 13 may be inserted into and fixed to the insertion space formed at the left end of the mask body. The second fixing part 14 may be inserted into and fixed to the insertion space formed at the right end of the mask body 10. The insertion space formed between the frame 11 and the front cover 12 may be referred to as a fixing recess 129*a* and 129*b* (see FIG. 5). Further description of the first fixing part 13 and the second fixing part 14 will be provided with respect to FIGS. 13 and 14.

The mask body 10 may include a packing 15. The packing 15 may be coupled to the frame 11. The packing 15 may be interposed between the frame 11 and the user's face when the mask body 10 is worn by the user. The packing 15 may be made of a material that may deform in shape corresponding to the user's face when the mask body 10 makes contact with the user's face. The packing 15 may be detachably mounted to the frame 11. For example, the packing 15 may be mounted on the frame 11 or attached to one side of the frame 11. The packing 15 may prevent a gap between the frame 11 and the user's face. Further description of the packing 15 will be provided with respect to FIGS. 6A and 6B.

The mask device 1 may include the first air cleaner 20 and the second air cleaner 40. The first air cleaner 20 and the second air cleaner 40 may be disposed at both sides of the mask body 10, respectively. In the present embodiment, the first air cleaner 20 may be disposed at the left end of the mask body 10, and the second air cleaner 40 may be disposed at the right end of the mask body 10.

The first air cleaner 20 and the second air cleaner 40 may be detachably mounted to the first fixing part 13 and the second fixing part 14. The first air cleaner 20 and the second air cleaner 40 may be movably coupled to the first fixing part 13 and the second fixing part 14. That is, the first air cleaner 20 and the second air cleaner 40 may be moved in the direction toward the frame 11 on both sides of the mask body 10. For example, the first air cleaner 20 may be folded with respect to the first fixing part 13, and the second air cleaner 40 may be folded with respect to the second fixing part 14. In the present embodiment, the first air cleaner 20 and the second air cleaner 40 are described as being folded with respect to the first fixing part 13 and the second fixing part 14, however they may be rotatable.

When the first air cleaner 20 and the second air cleaner 40 are folded, the mask device 1 may be easily stored. When the first air cleaner 20 and the second air cleaner 40 are folded in the direction toward the frame 11 at both ends of the mask body 10, the breathing space of the frame 11 may be shielded. When the breathing space of the frame 11 is shielded by the first air cleaner 20 and the second air cleaner 40, foreign matter from the outside environment may be prevented from being attached to the surface of the frame 11 defining a surface of the breathing space.

The first air cleaner 20 and the second air cleaner 40 may suck air in from the outside environment and filter the sucked in air. The filtered air may flow to the inside of the mask body 10 and through the inlet 111*a* and 111*b* to be supplied to the nose and mouth of the user. Since the filtered air is supplied to the user through each of the first air cleaner 20 and the second air cleaner 40, the flow rate of the filtered air may be increased, and a large amount of filtered air may be supplied to the user. This may help the user to breathe smoothly.

The first air cleaner 20 includes a first cleaner body 21 and a first cleaner cover 22, and the second air cleaner 40 includes a second cleaner body 41 and a second cleaner cover 42. The first and second cleaner bodies 21 and 41 and the first and second cleaner covers 22 and 42 may be detachably coupled to each other. When the first and second cleaner covers 22 and 42 are separated from the first and second cleaner bodies 21 and 41, the insides of the first and second cleaner bodies 21 and 41 may be exposed to the outside.

The first and second cleaner bodies 21 and 41 may have an internal space in which a plurality of components may be accommodated. The internal spaces of the first and second cleaner bodies 21 and 41 may be shielded by the first and second cleaner covers 22 and 42. First and second fan modules 24 and 44 (see FIGS. 7 and 8) and first and second filter modules 25 and 45 may be disposed in the first and second cleaner bodies 21 and 41. The first and second fan modules 24 and 44 may generate suction force for sucking in outside air. The first and second filter modules 25 and 45 may filter foreign matter from the sucked in air. The first and second filter modules 25 and 45 may be located upstream of the first and second fan modules 24 and 44 based on the flow direction of air. Alternatively, the first and second filter modules 25 and 45 may be located downstream of the first and second fan modules 24 and 44 based on the flow direction of air.

A battery 26 may be disposed inside the first cleaner body 21. The space where the first fan module 24 and the first filter module 25 are disposed and the space where the battery 26 is disposed may be formed in the first cleaner body 21. When the space in which the first fan module 24 and the first filter module 25 are disposed and the space in which the battery 26 is disposed are separated, it may be possible to limit the mixing of air in different spaces. The battery 26 may supply power for operating at least one of the first air cleaner 20 and the second air cleaner 40. The battery 26 may be coupled to at least one of the first air cleaner 20 and the second air cleaner 40 by an electric wire 19 (see FIG. 15).

A circuit board 46 (see FIG. 8) may be positioned inside the second cleaner body 41. The space where the second fan module 44 and the second filter module 45 are disposed and the space where the circuit board 46 is disposed may be formed in the second cleaner body 41. When the space in which the second fan module 44 and the second filter module 45 are disposed and the space in which the circuit board 46 is disposed are separated, it may be possible to limit the mixing of air in different spaces. The circuit board 46 may control the operation of at least one of the first air cleaner 20 and the second air cleaner 40. The circuit board 46 may be connected to at least one of the first air cleaner 20 and the second air cleaner 40 by the electric wire 19. On the other hand, the circuit board 46 may be provided in plurality. The plurality of circuit boards 46 may include a first circuit board for controlling the first air cleaner 20 and a second circuit board for controlling the second air cleaner 40.

When the battery 26 is disposed in any one of the first air cleaner 20 and the second air cleaner 40, the circuit board 46 may be disposed in the other one of the first air cleaner 20 and the second air cleaner 40. In other words, the battery 26 and the circuit board 46 balancing the weight of the battery 26 may be disposed inside different air cleaners to balance the weight of the mask device 10.

The first and second cleaner covers 22 and 42 may include first and second suction openings 221 and 421. The first and second suction openings 221 and 421 may be formed with a plurality of holes. A portion of the holes of the first and second suction openings 221 and 421 may communicate between the outside environment and the space in which the first and second fan modules 24 and 44 and the first and second filter modules 25 and 45 are disposed, respectively. A remaining portion of the holes of the first and second suction openings 221 and 421 may communicate between the outside environment and a space in which the battery 26 and the circuit board 46 are disposed, respectively. Air passing through the portion of the holes of the first and second suction openings 221 and 421 is supplied to the nose and mouth of the user, and air passing through the remaining portion of the holes of the first and second suction openings 221 and 421 may cool the battery 26 and the circuit board 46.

The first and second cleaner covers 22 and 42 may include first and second switches 222 and 422. The first and second switches 222 and 422 may be operation switches for operating the first and second air cleaners 20 and 40. For example, the first switch 222 may operate the first air cleaner 20, and the second switch 422 may operate the second air cleaner 40. Alternatively, the first switch 222 may operate the first and second air cleaners 20 and 40 together in which case, the second switch 422 may not be necessary. Alternatively, the second switch 422 may operate the first and second air cleaners 20 and 40 together in which case the first switch 222 may not be necessary. The output and operation of the first and second fan modules 24 and 44 may be controlled according to how long the first and second switches 222 and 422 are pressed or the number of times the first and second switches 222 and 422 are pressed. Further description of the first air cleaner 20 and the second air cleaner 40 will be provided with respect to FIGS. 7 and 8.

The mask device 1 may include a first separation preventing part 28 and a second separation preventing part 48. The first separation prevention part 28 may connect the first fixing part 13 and the first cleaner body 21. The second separation preventing part 48 may connect the second fixing part 14 and the second cleaner body 41. The first separation preventing part 28 and the second separation preventing part 48 may have a predetermined length. The first separation preventing part 28 may prevent the first cleaner body 21 from being separated from the first fixing part 13 by a specified distance or less. The second separation preventing part 48 may prevent the second cleaner body 41 from being separated from the second fixing part 14 by a specified distance or less.

The first separation preventing part 28 may be provided in plurality, spaced apart from each other between the first fixing part 13 and the first cleaner body 21. The second separation preventing part 48 may be provided in plurality, spaced apart from each other between the second fixing part 14 and the second cleaner body 41. One end portions of the first and second separation preventing parts 28 and 48 may be fixed to the first and second fixing parts 13 and 14, and the other end portions of the first and second separation preventing parts 28 and 48 may be respectively fixed to the first and second cleaner bodies 21 and 41. The first and second cleaner bodies 21 and 41 may move with respect to the first and second fixing parts 13 and 14 by the specified distance or less set by the first and second separation preventing parts 28 and 48.

The first separation prevention part 28 may be separated from at least one of the first fixing part 13 and the first cleaner body 21. The second separation preventing part 48 may be separated from at least one of the second fixing part 14 and the second cleaner body 41. When the first and second separation prevention parts 28 and 48 are separated from at least one of the first and second fixing parts 13 and 14 and the first and second cleaner bodies 21 and 41, the first and second air cleaners 20 and 40 may be separated from the mask body 10. When the first and second air cleaners 20 and 40 are separated from the mask body 10, first and second catchers 30 and 50 that are attached to the mask body 10 by the first and second air cleaners 20 and 40 may be detached. Thus, the first and second air cleaners 20 and 40 including the first and second catching parts 30 and 50 may be detachably mounted to the mask body 10 by the first and second separation preventing parts 28 and 48. Further descriptions of the first separation preventing part 28 and the second separation preventing part 48 will be described with respect to FIGS. 13 and 14.

The mask device 1 may include the first catching part 30 and the second catching part 50. The first catching part 30 and the second catching part 50 may be mounted to the first air cleaner 20 and the second air cleaner 40, respectively. The first catching part 30 may be mounted on the first air cleaner 20, and the second catching part 50 may be mounted on the second air cleaner 40. The first air cleaner 20 may be mounted on one side of the first catching part 30, and the second air cleaner 40 may be mounted on one side of the second catching part 50. The first catching part 30 may be configured to mount the first air cleaner 20 on the inside. The second catching part 50 may be configured to mount the second air cleaner 40 on the inside. The first catching part 30 may be fixed to the user's left ear, and the second catching part 50 may be fixed to the user's right ear. The mask body 10 may be fixed to the user's face by the first catching part 30 and the second catching part 50.

The first catching part 30 may include a first hanger body 31. The second catching part 50 may include a second hanger body 51. The first hanger body 31 and the second hanger body 51 may be formed to be fixed to the user's ears. For example, the first and second hanger bodies 31 and 51 may be provided in a string or ring shape to be fixed to the user's ears. One side of the first and second hanger body 31 and 51 may be fixed to the first and second air cleaner 20 and 40, the other side of the first and second hanger body 31 and 51 may be fixed to the user's ears. Between the first and second air cleaners 20 and 40 and the ears of the user, the first and second hanger bodies 31 and 51 may stretch or shrink in the longitudinal direction so that the mask body 10 may be fixed to the user's face.

A portion of the first air cleaner 20 may be locked to the first hanger body 31, and a portion of the second air cleaner 40 may be locked to the second hanger body 51. The first and second hanger bodies 31 and 51 and the first and second air cleaners 20 and 40 may be detachably coupled to each other. The first hanger body 31 may include a first handle 314 and a first contact part 32. The second hanger body 51 may include a second handle 514 and a second contact part 52. The first and second handles 314 and 514 may be parts that the user grasps when the first and second hanger bodies 31 and 51 are mounted on the user's ears. The first and second handles 314 and 514 may protrude from the other side of the first and second hanger bodies 31 and 51. The first and second contact parts 32 and 52 may be parts that contact the user's ears when the first and second hanger bodies 31 and 51 are mounted on the user's ears. The first and second contact parts 32 and 52 may be disposed on inner surfaces of the first and second hanger bodies 31 and 51. The load of the mask device 1 applied to the ears of the user may be distributed by the first and second contact parts 32 and 52. Further description of the first catching part 30 and the second catching part 50 will be described with respect to FIGS. 16 and 17.

Figure 5:
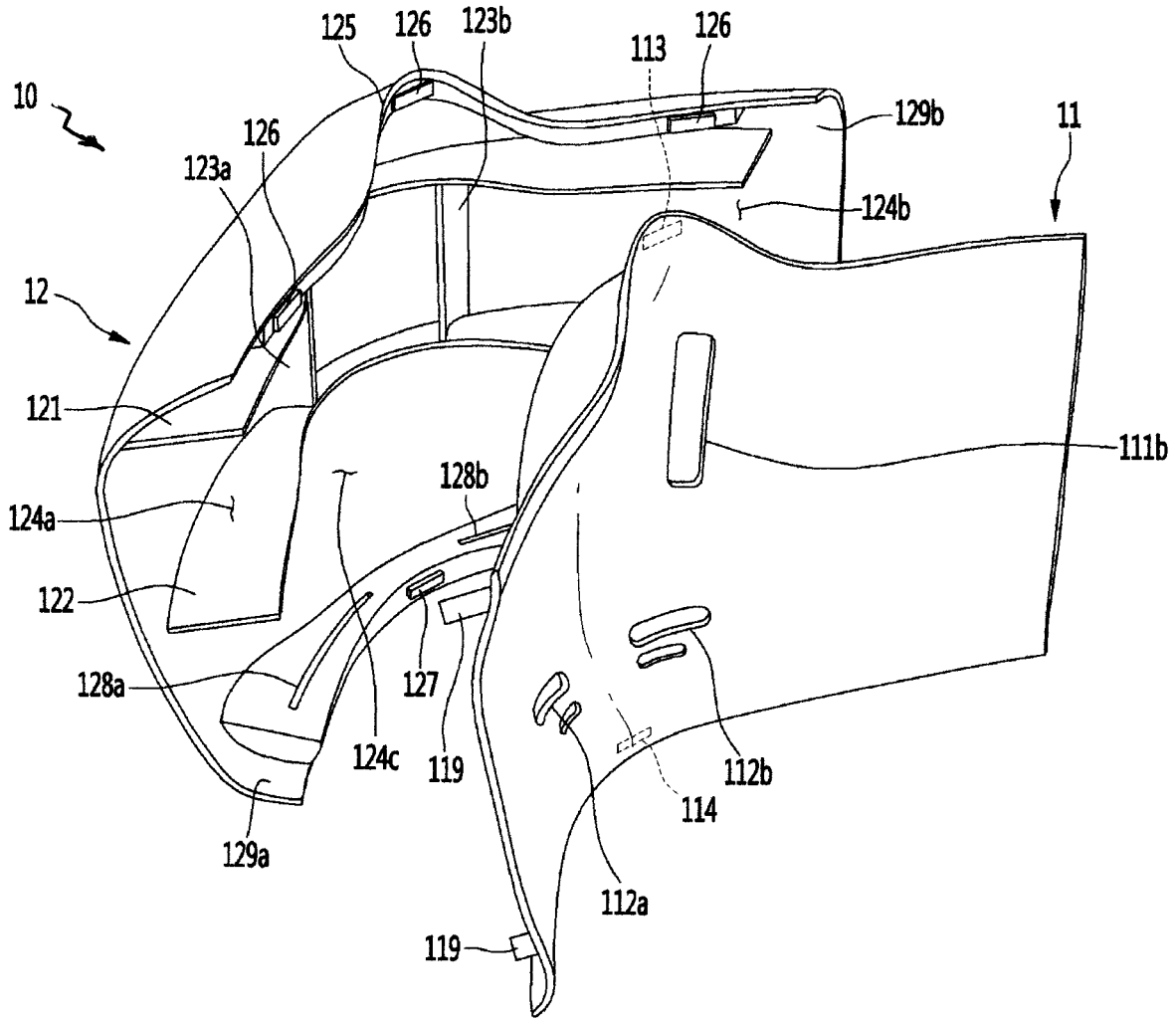
FIG. 5 is a rear exploded view of the mask body according to the first embodiment of the present invention.

FIG. 5 is a rear exploded view of the mask body according to the first embodiment of the present invention.

Referring to FIG. 5, the mask body 10 according to the embodiment may combine the frame 11 and the front cover 12 to form the body. The frame 11 and the front cover 12 may be detachably coupled to each other.

Flow passages 124*a*, 124*b* and 124*c* through which air passes may be disposed between the frame 11 and the front cover 12. The flow passages may include a flow passage for supplying filtered air to the user and a flow passage for discharging air to the outside environment. A partition may be formed between the frame 11 and the front cover 12 to form a flow path. The partition may be disposed on at least one of the frame 11 and the front cover 12. When the front cover 12 is coupled to the frame 11, the partition may define a flow passage between the front cover 12 and the frame 11.

The partition may include a first partition plate 121 and a second partition plate 122. The first partition plate 121 and the second partition plate 122 may start from one of the front cover 12 and the frame 11 and protrude to the other of the front cover 12 and the frame 11. For example, the first partition plate 121 and the second partition plate 122 may protrude from one surface of the front cover 12 facing the frame 11 toward the frame 11. The first partition plate 121 and the second partition plate 122 may be in contact with the frame 11 when the frame 11 and the front cover 12 are coupled to each other. The first partition plate 121 and the second partition plate 122 may be spaced apart from each other at regular intervals. The distance between the first partition plate 121 and the second partition plate 122 may define the flow cross-sectional areas of the flow passages 124*a* and 124*b*. The distance between the first partition plate 121 and the second partition plate 122 may be adjusted in consideration of the flow rate of air passing through the flow passages 124*a* and 124*b*. When the flow cross-sectional area of the flow passages 124*a* and 124*b* is kept constant, a decrease in the flow rate of air passing through the flow passages 124*a* and 124*b* may be prevented.

The second partition plate 122 may partition a space between the front cover 12 and the frame 11 into an upper space and a lower space. A flow passage for supplying air to the user's nose and mouth may be located in the upper space. A flow passage for discharging air discharged to the outside environment may be located in the lower space.

In the present embodiment, the first compartment plate 121 may be disposed above the second compartment plate 122. A first flow passage 124*a* and a second flow passage 124*b* may be formed between the first partition plate 121 and the second partition plate 122 to supply filtered air to the user. The first flow passage 124*a* and the second flow passage 124*b* may be passages through which air flowing toward the inlet 111*a* and 111*b* passes.

The first partition plate 121 may divide the upper space into a space in which the first flow passage 124*a* and the second flow passage 124*b* are formed and a space in which no flow passage is formed. A plurality of components may be disposed in the space where no flow passage is formed. For example, the plurality of components may include a fragrance module for supplying a fragrance, an ionizer for sterilizing air, and the like.

For example, the fragrance module may be provided on any one of the front cover 12 and the frame 11. The fragrance module may provide fragrance to air introduced into a user's nose and mouth through at least one of the first flow passage 124*a* and the second flow passage 124*b*. A porous part may be formed in the first partition plate 121 so that the fragrance of the fragrance module may be supplied to at least one of the first flow passage 124*a* and the second flow passage 124*b*. In addition, the porous part may be formed in at least one of a first inflow guide 123*a* and a second inflow guide 123*b*. The fragrance module may be removed and be replaced when the front cover 12 and the frame 11 are separated.

A third flow passage 124*c* may be formed in the lower space. The third flow passage 124*c* may be a passage through which air discharged through the outlet 112*a* and 112*b* passes. That is, the second partition plate 122 may partition the first flow passage 124*a*, the flow second passage 124*b*, and the third flow passage 124*c*.

The first partition plate 121 and the second partition plate 122 may perform a function of a support rib supporting the frame 11 and the front cover 12. The first partition plate 121 and the second partition plate 122 may function as reinforcing ribs to reinforce strength of at least one of the front cover 12 and the frame 11.

In the present embodiment, the second partition plate 122 may partition into the upper space and the lower space, and may be referred to as an "up and down partition plate". The first partition plate 121 may be a part of the first flow passage 124*a* and the second flow passage 124*b* and may perform a function for reinforcing strength. The first partition plate 121 may be referred to as a "reinforcement partition plate". For example, in configuring the partition of the upper space, if the first partition plate 121 is not provided, the flow rate of air that passes through the upper space may be increased.

The first inflow guide 123*a* and the second inflow guide 123*b* may be provided between the first partition plate 121 and the second partition plate 122. The first inflow guide 123*a* and the second inflow guide 123*b* may connect the first partition plate 121 and the second partition plate 122. The first inflow guide 123*a* and the second inflow guide 123*b* may be formed from any one of the first and second partition plates 121 and 122 and may extend toward the other one of the first and second partition plates 121 and 122. An extension length of the first inflow guide 123*a* and the second inflow guide 123*b* may correspond to the separation distance between the first compartment plate 121 and the second compartment plate 122. The first inflow guide 123*a* and the second inflow guide 123*b* may extend in a direction toward the front cover 12 and the frame 11, and may extend to the front cover 12 and the frame 11.

The first inflow guide 123*a* and the second inflow guide 123*b* may fill the space between the first partition plate 121 and the second partition plate 122 with the first flow passage 124*a* and the second flow passage 124*b*. The first inflow guide 123*a* and the second inflow guide 123*b* may be spaced apart from each other in both directions. For example, the first inflow guide 123*a* may be located in the left direction of the user's nose. The second inflow guide 123*b* may be located in the right direction of the user's nose. Thus, a user's nose may be located between the first inflow guide 123*a* and the second inflow guide 123*b*.

The first inlet guide 123*a* may guide an air flow direction such that air supplied from the first air cleaner 20 may flow to the first inlet 111*a* among the inlet 111*a* and 111*b*. The second inflow guide 123*b* may guide the air flow direction such that the air supplied from the second air cleaner 40 flows to the second inlet 111*b* of the inlet 111*a* and 111*b*. The first inflow guide 123*a* and the second inflow guide 123*b* may be formed to be inclined such that air flows in a direction toward the first and second inlets 111*a* and 111*b*. For example, the first inflow guide 123*a* and the second inflow guide 123*b* may be inclined in a direction from the front cover 12 toward the frame 11. When the front cover 12 and the frame 11 are coupled to each other, the first inflow guide 123*a* and the second inflow guide 123*b* may connect the first flow passage 124*a* and the second flow passage 124*b*. In the present embodiment, the first inlet 111*a* may be located at the left side of the user's nose, and the second inlet 111*b* may be located at the right side of the user's nose.

Air passing through the outlet 112*a* and 112*b* may be introduced into the third passage 124*c*. The outlet 112*a* and 112*b* may include a first outlet 112*a* disposed at the left side and a second outlet 112*b* disposed at the right side with respect to the center of the mask body 10. The first outlet 112*a* may be spaced apart from the user's nose in the direction toward the user's mouth. The second outlet 112*b* may be spaced apart from the user's nose in the direction toward the user's mouth. The air discharged from the user's nose and mouth may pass through the first and second outlet 112*a* and 112*b* and then enter the third passage 124*c*.

The mask body 10 may be provided with a discharge port 128*a* and 128*b* for discharging the air introduced into the third passage 124*c* to the external environment. The discharge port 128*a* and 128*b* may include a first discharge port 128*a* disposed on the left side and a second discharge port 128*b* disposed on the right side with respect to the center of the mask body 10. Air discharged from the first outlet 112*a* may be introduced into the first discharge port 128*a*. Air discharged from the second outlet 112*b* may be introduced into the second discharge port 128*b*. The discharge port 128*a* and 128*b* may be formed in any one of the front cover 12 and the frame 11. In the present embodiment, the discharge port 128*a* and 128*b* is described as being formed in the front cover 12. The discharge port 128*a* and 128*b* may be formed at the lower portion of the front cover 12. When the discharge port 128*a* and 128*b* is formed at the lower portion of the front cover 12, it may be possible to minimize the mixing of the air discharged from the mask device 1 with the air sucked into the mask device 1. In addition, the noise of the air being discharged from the discharge port 128*a* and 128*b* may be limited. It should be noted that the position of the discharge port 128*a* and 128*b* may be variously changed.

One of the discharge port 128*a* and 128*b* and the outlet 112*a* and 112*b* may be provided with a check valve 118. The check valve 118 may prevent discharged air from flowing back into the mask device 1. The check valve 118 may prevent unfiltered air from the outside environment from entering the user's nose and mouth through any one of the discharge port 128*a* and 128*b* and the outlet 112*a* and 112*b*. The check valve 118 may be closed when the user inhales the filtered air to prevent the outside air from flowing into any one of the discharge port 128*a* and 128*b* and the outlet 112*a* and 112*b*. The check valve 118 may be opened to discharge the air exhaled by the user to be discharged to the outside environment. The check valve 118 may be disposed on at least one side of the discharge port 128*a* and 128*b* and the outlet 112*a* and 112*b*, and may open or close at least one of the discharge port 128*a* and 128*b* and the outlet 112*a* and 112*b*.

The front cover 12 may include an upper fastener 126 and a lower fastener 127. The upper fastener 126 and the lower fastener 127 may be provided in plural. The upper fastener 126 may be located at a upper portion of the front cover 12. A plurality of upper fasteners 126 may be spaced apart from each other in both directions of the front cover 12. The lower fastener 127 may be located at the lower portion of the front cover 12. A plurality of lower fasteners 127 may be spaced apart from each other in both directions of the front cover 12. The upper and lower portions of the front cover 12 may further include support ribs on which the upper fastener 126 and the lower fastener 127 are located. The support ribs may protrude from the upper and lower portions of the front cover 12. The upper fastener 126 may be positioned to face an upper fixture 113. The lower fastener 127 may be positioned to face a lower fixture 114.

The frame 11 may include the upper fixture 113 and a lower fixture 114. The upper fixture 113 and the lower fixture 114 may be provided in plural. The upper fixture 113 may be disposed at the upper portion of the frame 11. A plurality of upper fixtures 113 may be spaced apart from each other in both directions. The lower fixture 114 may be disposed at the lower portion of the frame 11. A plurality of lower fixtures 114 may be spaced apart from each other in both directions. The upper fixture 113 may be disposed at a position corresponding to the upper fastener 126, and the lower fixture 114 may be disposed at a position corresponding to the lower fastener 127. Alternatively, the upper fastener 126 and the lower fastener 127 may be disposed on the frame 11, and the upper fixture 113 and the lower fixture 114 may be disposed on the front cover 12.

In the present embodiment, the upper fixture 113, the lower fixture 114, the upper fastener 126, and the lower fastener 127 may be provided as a magnet member. Alternatively, the upper fastener 126 and the lower fastener 127 may be provided as a fastening member, and the upper fixture 113 and the lower fixture 114 may be provided as fastening grooves to which the fastening member is fastened. When the upper fastener 126 is coupled to the upper fixture 113, the upper portion of the frame 11 and the upper portion of the front cover 12 may be fixed to each other. When the lower fastener 127 is coupled to the lower fixture 114, the lower portion of the frame 11 and the lower portion of the front cover 12 may be fixed to each other.

The mask body 10 may include a first fixing recess 129*a* and a second fixing recess 129*b*. The first fixing part 13 may be fixed to the first fixing recess 129*a*, and the second fixing part 14 may be fixed to the second fixing recess 129*b*. The first fixing recess 129*a* and the second fixing recess 129*b* may be disposed between the front cover 12 and the frame 11. A portion of the first fixing recess 129*a* and the second fixing recess 129*b* may be defined by the front cover 12, and the remaining portion of the first fixing recess 129*a* and the second fixing recess 129*b* may be defined by the frame 11. The first fixing recess 129*a* and the second fixing recess 129*b* may be disposed at both sides of the mask body 10, respectively.

When the front cover 12 and the frame 11 are coupled to each other, the end portions of the first fixing part 13 and the second fixing part 14 may be fixed between the front cover 12 and the frame 11. The first fixing recess 129*a* may be disposed at the left end of the mask body 10. The second fixing recess 129*b* may be disposed at the right end of the mask body 10. The first fixing recess 129*a* and the second fixing recess 129 provided for fixing the first fixing part 13 and the second fixing part 14 to the mask body 10.

A plurality of fixing protrusions 119 may provide for fixing the first fixing part 13 and the second fixing part 14 to the mask body 10. The plurality of fixing protrusions 119 may be disposed on at least one of the front cover 12 and the frame 11. In the present embodiment, the plurality of fixing protrusions 119 may be provided in the frame 11. The plurality of fixing protrusions 119 may be disposed at both ends of the frame 11, respectively. The plurality of fixing protrusions 119 may be spaced apart from each other. A plurality of fixing protrusion insertion holes into which the plurality of fixing protrusion 119 may be inserted may be formed in the first fixing part 13 and the second fixing part 14. The plurality of fixing protrusions 119 are inserted into the respective plurality of fixing protrusion insertion holes so that the first fixing part 13 and the second fixing part 14 are firmly fixed into the first fixing recess 129*a* and the second fixing recess 129*b*.

Figure 6A:
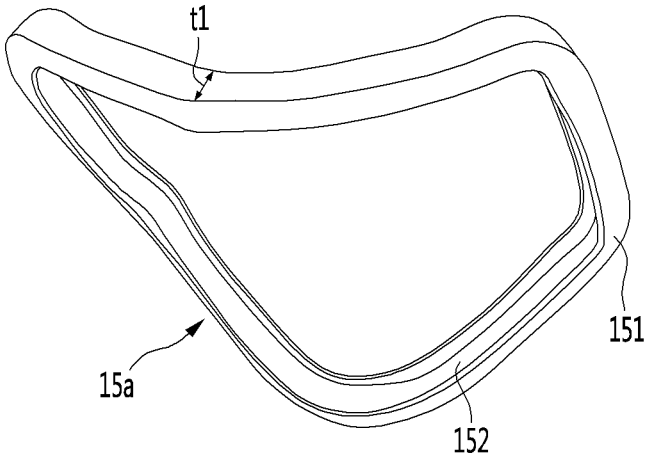
FIGS. 6A and 6B are views showing a packing according to the first embodiment of the present invention.
Figure 6B:
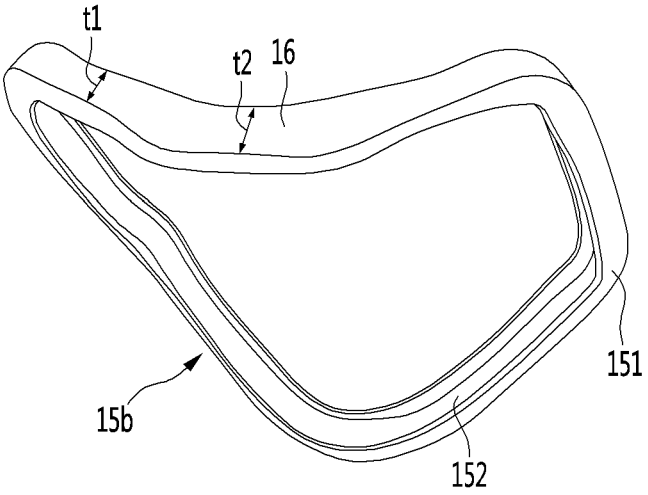

FIGS. 6A and 6B are views showing a packing according to the first embodiment of the present invention.

Referring to FIGS. 6A and 6B, the mask body 10 according to the embodiment may include a packing 15*a* and 15*b*. The packing 15*a* and 15*b* may be detachably coupled to the mask body 10. For example, the packing 15*a* and 15*b* may be detachably coupled to the frame 11. The packing 15*a* and 15*b* may be disposed between the user's face and the mask body 10. The packing 15*a* and 15*b* may disperse the pressure applied to the user's face when the mask body 10 is in close contact with the user's face. The packing 15*a* and 15*b* may seal a gap that may form between the user's face and the mask body 10 when the mask body 10 is in close contact with the user's face. In the present embodiment, the packing 15*a* and 15*b* may be formed in a configuration shown in FIG. 6A and FIG. 6B. FIG. 6A shows an embodiment of the first packing 15*a* and FIG. 6B shows an embodiment of the second packing 15*b*.

Referring to FIG. 6A, the first packing 15*a* may include a packing body 151 forming a body. The packing body 151 may be mounted at the corner or the outer circumferential surface of the frame 11. The packing body 151 may be formed to correspond to an edge or outer circumferential surface of the frame 11. The first packing 15*a* may be made of a material that is easily deformed and may be deformed when the first packing 15*a* is in close contact with the user's face. For example, the first packing 15*a* may be made of silicon, rubber, or the like. The packing body 151 may be formed to be hollow inside. For example, the packing body 151 may be formed in a ring or ring shape being hollow inside. The frame 11 may be disposed inside the hollow portion of the packing body 151. The packing body 151 may be formed to have a constant first thickness t1. In this case, the first thickness t1 may be greater than the thickness of the frame 11. The packing body 151 having the first thickness t1 may be deformed in thickness between the user's face and the frame 11.

The packing body 151 may include a frame insertion groove 152. The frame insertion groove 152 may be understood as a portion in which an edge or an outer circumferential surface of the frame 11 is inserted and fixed. The frame insertion groove 152 may be formed by recessing an inner portion of the packing body 151. For example, the frame insertion groove 152 may be recessed in a direction from the inner surface of the packing body 151 toward the outer surface of the packing body 151.

When the mask body 10 is in close contact with the user's face, the packing body 151 may contact the user's face rather than the frame 11. In the state of being in contact with the user's face, the packing body 151 may deform to close the gap and bring the mask body 10 into close contact with the user's face.

Referring to FIG. 6B, the second packing 15*b* may include a packing body 151 forming a body. The packing body 151 may be formed to have a constant first thickness t1 with a portion of the packing body 151 being formed to have a second thickness t2. The second thickness t2 may be larger than the first thickness t1. The portion of the packing body 151 having the second thickness t2 may be located in front of the nose of the user, so that a gap that may be formed between the user's nose and the frame 11 may be more closely sealed.

For example, the user's nose and the frame 11 that is not sealed by the packing body 151 having the first thickness t1 may have a gap between the user's nose and the packing body 151, but having the second thickness t2 may seal the gap. In addition, a portion of the packing body 151 having the second thickness t2 may be seated on a user's nose. When a part of the packing body 151 having the second thickness t2 is seated on the user's nose, a supporting function of supporting the mask body 10 on the user's nose may be performed. Thus, a part of the packing body 151 having the second thickness t2 may be considered as a nose support 16.

The packing body 151 may include a frame insertion groove 152. The frame insertion groove 152 may be a part into which the frame 11 is inserted and fixed to the packing.

In the present embodiment, the frame 11 is described as being inserted into and fixed to the frame insertion groove 152 of the packing, but the packing is attached to one surface of the frame 11. Or combination of structures are also possible. The packing may be detachably coupled to the edge or the outer circumferential surface of the frame 11 to be in close contact with the user's face.

Figure 7:
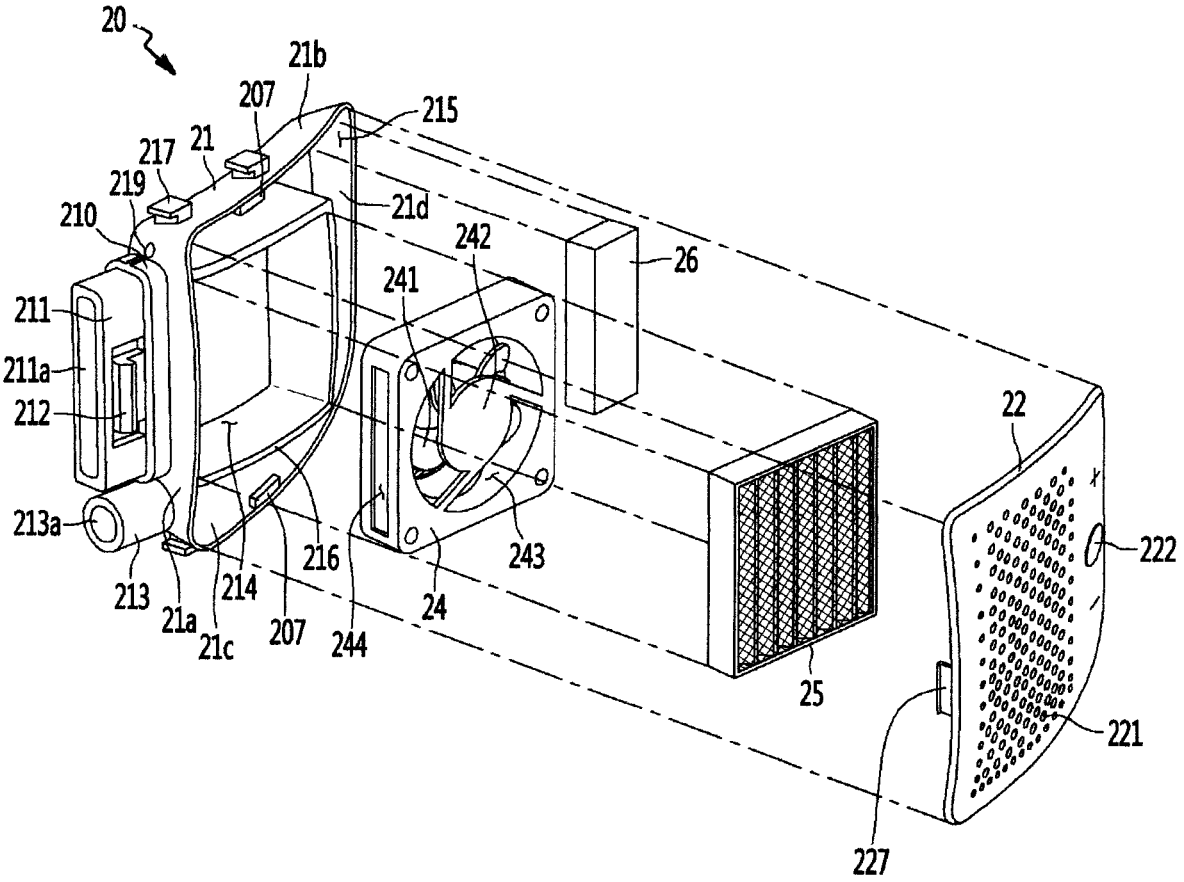
FIG. 7 is an exploded view of a first air cleaner according to the first embodiment of the present invention.
Figure 8:
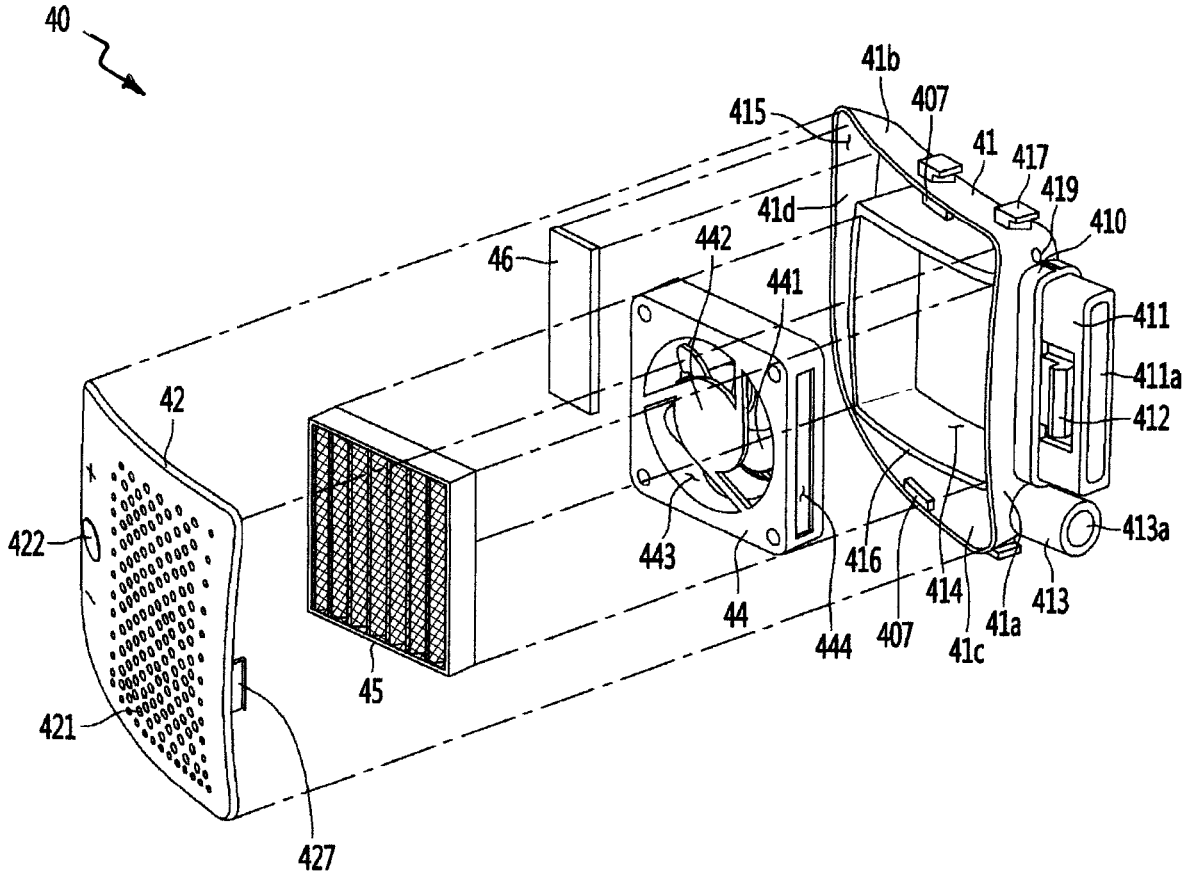
FIG. 8 is an exploded view of a second air cleaner according to the first embodiment of the present invention.

FIG. 7 is an exploded view of the first air cleaner according to the first embodiment of the present invention, and FIG. 8 is an exploded view of the second air cleaner according to the first embodiment of the present invention.

Referring to FIGS. 7 and 8, the mask device 1 according to the embodiment may include the first air cleaner 20 and the second air cleaner 40. The first air cleaner 20 and the second air cleaner 40 may suck in outside air from both sides of the mask body 10. The air sucked into the first air cleaner 20 and the second air cleaner 40 may be filtered inside the first air cleaner 20 and the second air cleaner 40. Filtered air may flow into the mask body 10. The filtered air may be supplied to the user's nose and mouth after passing through the first flow passage 124*a* and the second flow passage 124*b* of the mask body 10. The first air cleaner 20 and the second air cleaner 40 may be operated together. Alternatively, the first air cleaner 20 and the second air cleaner 40 may be operated individually.

Hereinafter, the first air cleaner 20 and the second air cleaner 40 will be described in order.

Referring to FIG. 7, the first air cleaner 20 may include a first cleaner body 21. The first cleaner body 21 may be deeply recessed in the interior, and a plurality of components may be stored in the recessed interior. For example, the first fan module 24, the first filter module 25, and the battery 26 may be stored in the first cleaner body 21. In the present embodiment, the first cleaner body 21 may include a bottom face facing the user's face, a plurality of side surfaces bent from the bottom face, and an upper surface opened to insert a plurality of components. For example, the first cleaner body 21 may be formed in a container shape in which one surface thereof is opened. The first cleaner body 21 may form a body by a bottom surface, a first side surface 21*a*, a second side surface 21*b*, a third side surface 21*c*, and a fourth side surface 21*d*. Side surfaces of the first cleaner body 21 may include the first side surface 21*a*, the fourth side surface 21*d* facing the first side surface 21*a*, the second side surface 21*b* and the third side surface 21*c* coupling the first side surface 21*a* and the fourth side surface 21*d*. The bottom surface couples one side of the side surfaces 21*a*-21*d*. The upper surface facing the bottom surface may be opened.

The first cleaner body 21 may include a first protrusion 210. The first protrusion 210 may protrude from one surface of the first cleaner body 21. The first protrusion 210 may be located at the side of the first cleaner body 21. In the present embodiment, the first protrusion 210 may be located on the first side surface 21*a*. When the first cleaner body 21 is coupled to the first fixing part 13, the first protrusion 210 limits the amount of insertion of a first duct 211 into the first fixing part 13, and thus may perform as a stopper function. For example, the first protrusion 210 may be formed to have a rectangular cross section. When the first cleaner body 21 is coupled to the first fixing part 13, the first protrusion 210 may be in contact with a portion of the first fixing part 13. The first protrusion 210 and the first duct 211 of the first cleaner body 21 is first inserted into a first duct through hole 311 of the first catching part 30 (see FIG. 4), and a part of the first catching part 30 contacts the first fixing part 13 with the first duct 211 being inserted into the first fixing part 13. A portion of the first cleaner body 21 may be disposed between the hanger body 31 of the first catching part 30.

The first cleaner body 21 may include the first duct 211. The first duct 211 may be formed to protrude further from the first protrusion 210. The first duct 211 may have a diameter smaller than the diameter of the first protrusion 210. The first duct 211 may be inserted into the first fixing part 13 of the mask body 10. The first duct 211 may couple the first cleaner body 21 and the mask body 10. The first duct 211 may be an air passage for supplying the air filtered by the first air cleaner 20 to the mask body 10. When the first duct 211 is inserted into the first fixing part 13 and the first protrusion 210 contacts a part of the first fixing part 13, the first air cleaner 20 may be fixed to the mask body 10. When the first duct 211 is separated from the first fixing part 13, the first air cleaner 20 and the mask body 10 may be separated from each other. For example, the first duct 211 may be formed to have a rectangular cross section. When the first duct 211 is formed to have a rectangular cross section, binding between the first fixing part 13 and the first cleaner body 21 may be facilitated.

A first air flow hole 211*a* may be formed in the first duct 211 and the first protrusion 210. The first air flow hole 211*a* may be formed by opening an interior of the first duct 211 and the first protrusion 210. The first air flow hole 211*a* may pass through the first duct 211 and the first protrusion 210. One side of the first air flow hole 211*a* may be in communication with a first air flow space 214 formed in the first cleaner body 21. The other side of the first air flow hole 211*a* may communicate with the first flow passage 124*a* of the mask body 10. The first cleaner body 21 and the mask body 10 may communicate with each other by the first air flow hole 211*a*.

The first cleaner body 21 may include a first fixing hook 212. The first fixing hook 212 may be formed at the first duct 211. The first fixing hook 212 may be formed by cutting a portion of the first duct 211. The first fixing hook 212 may elastically deform with respect to the first duct 211 when the first fixing hook 212 is being mounted or detached from the first fixing part 13. When the first duct 211 is coupled to the first fixing part 13, the first fixing hook 212 may be fixed to the first fixing part 13. The first fixing hook 212 fixed to the first fixing part 13 may be released by a first fixing hook releasing part 133 (see FIG. 4) formed at the first fixing part 13.

The first cleaner body 21 may include a first wire tube 213. The first wire tube 213 may protrude from the first cleaner body 21. The first wire tube 213 may protrude from the side of the first cleaner body 21. The first wire tube 213 may be disposed on the first side surface 21*a* of the first cleaner body 21. The first wire tube 213 may be disposed at one side of the first duct 211. The first wire tube 213 may be a passage through which the wire 19 passes. The first wire tube 213 may be an opening into which the first separation preventing part 28 may be inserted in one embodiment. The first wire tube 213 may provide communication between a first accommodation space 215 formed in the first cleaner body 21 and the third flow passage 124*c* formed in the mask body 10. The first wire tube 213 may be inserted into a part of the first fixing part 13. For example, the first wire tube 213 may be formed to have a circular or square cross section.

The first wire tube 213 may include a first wire through hole 213*a*. The first wire through hole 213*a* may be formed by opening an interior of the first wire tube 213. One side of the first wire through hole 213*a* may communicate with the first accommodation space 215. The other side of the first wire through hole 213*a* may communicate with the third flow passage 124*c*. A portion of the air passing through the third flow passage 124*c* may be introduced into the first accommodating space 215 by the first wire through hole 213*a*. When the air flows into the first accommodation space 215, a plurality of components stored in the first accommodation space 215 may be cooled.

The first cleaner body 21 may include a first compartment rib 216. The first compartment rib 216 may be provided inside the first cleaner body 21. The first compartment rib 216 may divide the internal space of the first cleaner body 21 into the first air flow space 214 and the first accommodation space 215. The first compartment rib 216 may protrude from an inner surface of the first cleaner body 21. For example, the first compartment rib 216 may be formed to protrude in a direction toward an upper surface opened from the bottom of the first cleaner body 21. The first fan module 24 and the first filter module 25 may be accommodated in the first air flow space 214, and air may pass therethrough. The first compartment rib 216 may define a shape of the first air flow space 214 to accommodate the first fan module 24 and the first filter module 25. The first fan module 24 and the first filter module 25 may be mounted in the first air flow space 214. The first accommodating space 215 may include the battery 26 or a plurality of components including the battery 26.

The first cleaner body 21 may include the first fan module 24 and the first filter module 25. The first fan module 24 and the first filter module 25 may be disposed in the first air flow space 214 formed by the first compartment rib 216. The first fan module 24 may generate a suction force for sucking in outside air. The first filter module 25 may filter foreign matter from the outside air sucked in by the first fan module 24. The first filter module 25 may be located upstream of the first fan module 24 based on the flow direction of air. The filtered air filtered by the first filter module 25 may flow through the first air flow hole 211*a* into the first flow passage 124*a*. Further description of the first filter module 25 will be described with respect to FIGS. 9 and 10.

The first fan module 24 may have a body having a size that may be insertable into the first air flow space 214. The first fan module 24 may include a first fan 241 and a first fan motor 242. The first fan 241 may be coupled to the first fan motor 242, and may rotate by receiving power from the first fan motor 242. Air may be sucked in by the rotation of the first fan 241. The first fan 241 may be provided as a cross flow fan, an axial flow fan, a centrifugal fan, or the like. The first fan motor 242 may be provided as an AC motor, a DC motor, a BLDC motor, or the like.

The first fan module 24 may include a first inlet opening 243 and a first outlet opening 244. The first inlet opening 243 may be an inlet opening for allowing external air to flow in a direction toward the first fan module 24. The first outlet opening 244 may be a discharge opening through which air introduced into the first inlet opening 243 is discharged. The air discharged through the first outlet opening 244 may flow into the first air flow hole 211*a*. The first inlet opening 243 may communicate with the first suction opening 221. The first outlet opening 244 may communicate with the first air flow hole 211*a*. When the first filter module 25 is positioned upstream of the first inlet opening 243, the filtered air flows from the first inlet opening 243 towards the first outlet opening 244.

The first cleaner body 21 may include the battery 26. The battery 26 may be disposed inside the first accommodation space 215. The battery 26 may be disposed to be detachable from the first cleaner body 21. The battery 26 may supply power to at least one of the first air cleaner 20 and the second air cleaner 40.

The first cleaner body 21 may include a first locking hook 217. The first locking hook 217 may be provided in plurality. The first locking hook 217 may allow the first catching part 30 and the first cleaner body 21 to be coupled to each other. The first locking hook 217 may protrude from the side of the first cleaner body 21. The plurality of first locking hooks 217 may be located on the second side 21*b* and the third side 21*c* of the first cleaner body 21. A portion of the first locking hook 217 protruding outward may be bent in a direction toward the first protrusion 210. The first locking hook 217 may protrude outward from the second side surface 21*b* and the third side surface 21*c* and then be bent in a direction toward the first side surface 21*a*. The first locking hook 217 may be fixed to the first catching part 30 by the bent portion of the first locking hook 217, and separation of the first locking hook 217 from the first catching part 30 may be prevented.

The first cleaner body 21 may include a first opening 219. The first opening 219 may be an opening through which a first separation preventing strap 281 of the first separation preventing part 28 passes. The first opening 219 may be located on the first side surface 21*a*. The first opening 219 may be formed in a size corresponding to the first separation prevention strap 281. For example, one opening of the plurality of first openings 219 may be located near the first protrusion 210, and the other opening may be located near the first wire tube 213. The first wire tube 213 and the first protrusion 210 may be positioned between the one opening 219 and the other opening 219. The first air cleaner 20 may be easily folded with respect to the mask body 10 by the first separation preventing part 28 provided in the one opening 219 and the other opening 219.

The first cleaner body 21 may include a first cover fixing part 207. The first cover fixing part 207 may be for fixing the first cleaner cover 22 to the first cleaner body 21. In the present embodiment, the first cover fixing part 207 may be provided in the first cleaner body 21, but may be provided in the first cleaner cover 22. At least one of the first cleaner body 21 and the first cleaner cover 22 may be provided with a first cover coupling part coupled to the first cover fixing part 207. The first cover fixing part 207 and the first cover coupling part may be located at positions corresponding to each other. The first cover fixing part 207 and the first cover coupling part may include a magnet member, a fastening member, and the like, and may be detachably coupled to each other.

The first air cleaner 20 may include the first cleaner cover 22. The first cleaner cover 22 may cover the first cleaner body 21. The first cleaner cover 22 may be detachably mounted on the opened upper surface of the first cleaner body 21 by the first cover fixing part 207 and the first cover coupling part. When the first cleaner cover 22 is mounted to the first cleaner body 21, the first cleaner cover 22 may contact the first compartment rib 216. When the first cleaner cover 22 is mounted on the first cleaner body 21, the inner space of the first cleaner body 21 may be partitioned into the first air flow space 214 and the first accommodation space 215.

The first cleaner cover 22 may include the first suction opening 221. The first suction opening 221 may be formed with a plurality of holes or may have a mesh shape at the first cleaner cover 22. Some of the plurality of first suction openings 221 may communicate with the first air flow space 214. Those first suction openings 221 may be located above the first air flow space 214. The remaining of the plurality of first suction openings 221 may communicate the first accommodation space 215. The remaining plurality of first suction openings 221 may be located above the first accommodation space 215. Air passing through the some of the plurality of first suction holes 221 may be sucked into the first air flow space 214. The first accommodation space 215 may be ventilated by the air flowing in or out through the remaining plurality of first suction openings 221. Large foreign matter contained in the outside air may be filtered by the first suction opening 221.

The first cleaner cover 22 may include a first switch 222. The first switch 222 may be exposed on the outer side of the first cleaner cover 22. The first switch 222 may an operation switch for operating the first air cleaner 20. The first switch 222 may be provided as a power switch to turn on/off the first air cleaner 20. The first switch 222 may be used as an operation switch for controlling the operation of the first air cleaner 20 according to the duration of the first switch 222 pressed, the number of times of the first switch 222 is pressed, etc. In the present embodiment, the first switch 222 shows as being one, however a plurality of switches may be provided as needed. The plurality of switches may also be referred to as a switch.

The first cleaner cover 22 may include a switch circuit board for driving the first switch 222. The switch circuit board may be located at an inner surface of the first cleaner cover 22 corresponding to the first accommodation space 215. When the first cleaner body 21 and the first cleaner cover 22 are coupled, the switch circuit board may be stored in the first accommodation space 215.

The first cleaner cover 22 may include a first mounting hook 227. The first mounting hook 227 may be for fixing the first cleaner cover 22 to the first cleaner body 21. A first hook mounting groove may be formed in the first cleaner cover 22 to mount the first mounting hook 227. The first cleaner cover 22 may be fixed to the first cleaner body 21 when the first mounting hook 227 is mounted in the first hook mounting groove. The first mounting hook 227 may allow the first cleaner cover 22 to be fixed to the first cleaner body 21 together with the first cover fixing part 207 and the first cover coupling part.

Referring to FIG. 8, the second air cleaner 40 may include a second cleaner body 41. The second cleaner body 41 may form a body of the second air cleaner 40. The second cleaner body 41 may be deeply recessed inside, and a plurality of components may be stored in the recessed interior. For example, the second fan module 44, the second filter module 45, and the circuit board 46 may be stored in the second cleaner body 41. In the present embodiment, the second cleaner body 41 may include a bottom facing the user's face, a plurality of side surfaces bent from the bottom, and an upper surface opened to insert a plurality of components. For example, the second cleaner body 41 may be formed in a container shape in which one surface thereof is opened. The second cleaner body 41 may form a body by a bottom surface, a first side surface 41*a*, a second side surface 41*b*, a third side surface 41*c*, and a fourth side surface 41*d*. Side surfaces of the second cleaner body 41 may include the first side surface 41*a*, the fourth side surface 41*d* facing the first side surface 41*a*, the second side surface 41*b* and the third side surface 41*c* coupling the first side surface 41*a* and the fourth side surface 41*d*. The bottom surface couples one surface of the side surfaces 41*a*-41*d*. The upper surface facing the bottom surface may be opened.

The second cleaner body 41 may include a second protrusion 410. The second protrusion 410 may protrude from one surface of the second cleaner body 41. The second protrusion 410 may be located at the side of the second cleaner body 41. In the present embodiment, the second protrusion 410 may be located on the first side surface 41*a*. When the second cleaner body 41 is coupled to the second fixing part 14, the second protrusion 410 limits the amount of insertion of the second duct 411 inserted into the second fixing part 14, and thus may perform as a stopper function. For example, the first protrusion 210 may be formed to have a rectangular cross section. When the second cleaner body 41 is coupled to the second fixing part 14, the second protrusion 410 may be in contact with a portion of the second fixing part 14. The second protrusion 410 and the second duct 411 of the second cleaner body 41 is first inserted into a second duct through hole 511 of the second catching part 50, and a part of the second catching part 50 contacts the second fixing part 14 with the second duct 411 being inserted into the second fixing part 14. A portion of the second cleaner body 41 may be disposed between the hanger body 31 of the second catching part 50.

The second cleaner body 41 may include the second duct 411. The second duct 411 may formed to protrude further from the second protrusion 410. The second duct 411 may have a diameter smaller than the diameter of the second protrusion 410. The second duct 411 may be inserted into the second fixing part 14 of the mask body 10. The second duct 411 may couple the second cleaner body 41 and the mask body 10. The second duct 411 may be an air passage for supplying air filtered by the second air cleaner 40 to the mask body 10. When the second duct 411 is inserted into the second fixing part 14 and the second protrusion 410 contacts a part of the second fixing part 14, the second air cleaner 40 may be fixed to the mask body 10. When the second duct 411 is separated from the second fixing part 14, the second air cleaner 40 and the mask body 10 may be separated from each other. For example, the second duct 411 may be formed to have a rectangular cross section. When the second duct 411 is formed to have a rectangular cross section, binding between the second fixing part 14 and the second cleaner body 41 may be facilitated.

A second air flow hole 411*a* may be formed in the second duct 411 and the second protrusion 410. The second air flow hole 411*a* may be formed by opening an interior of the second duct 411 and the second protrusion 410. The second air flow hole 411*a* may pass through the second duct 411 and the second protrusion 410. One side of the second air flow hole 411*a* may be in communication with the second air flow space 414 formed in the second cleaner body 41. The other side of the second air flow hole 411*a* may be in communication with the second flow passage 124*b* of the mask body 10. The second cleaner body 41 and the mask body 10 may communicate with each other by the second air flow hole 411*a*.

The second cleaner body 41 may include a second fixing hook 412. The second fixing hook 412 may be formed in the second duct 411. The second fixing hook 412 may be formed by cutting a portion of the second duct 411. The second fixing hook 412 may elastically deform with respect to the second duct 411 when the second fixing hook 412 is mounted or detached from the second fixing part 14. When the second duct 411 is connected to the second fixing portion 14, the second fixing hook 412 may be fixed to the second fixing part 14. The second fixing hook 412 fixed to the second fixing part 14 may be released by a second fixing hook releasing part 143 formed on the second fixing part 14.

The second cleaner body 41 may include a second wire tube 413. The second wire tube 413 may protrude from the second cleaner body 41. The second wire tube 413 may protrude from the side of the second cleaner body 41. The second wire tube 413 may be disposed on the first side surface 41*a* of the second cleaner body 41. The second wire tube 413 may be disposed at one side of the second duct 411. The second wire tube 413 may be a passage through which the wire 19 passes. The second wire tube 413 may be an opening into which the second separation preventing part 48 is inserted in one embodiment. The second wire tube 413 may communicate between the second accommodation space 415 formed in the second cleaner body 41 and the third flow passage 124*c*. The second wire tube 413 may be inserted into a part of the second fixing part 14. For example, the second wire tube 413 may be formed to have a circular or square cross section.

The second wire tube 413 may include a second wire through hole 413*a*. The second wire through hole 413*a* may be formed by opening an interior of the second wire tube 413. One side of the second wire through hole 413*a* may communicate with the second accommodation space 415. The other side of the second wire through hole 413*a* may communicate with the third flow passage 124*c*. A portion of the air passing through the third flow passage 124*c* may be introduced into the second accommodation space 415 by the second wire through hole 413*a*. When air flows into the second accommodation space 415, a plurality of components stored in the second accommodation space 415 may be cooled.

The second cleaner body 41 may include a second compartment rib 416. The second compartment rib 416 may be provided inside the second cleaner body 41. The second compartment rib 416 may divide the internal space of the second cleaner body 41 into a second air flow space 414 and a second accommodation space 415. The second compartment rib 416 may protrude from an inner surface of the second cleaner body 41. For example, the second compartment rib 416 may be formed to protrude in a direction toward an upper surface opened from the bottom of the second cleaner body 41. The second fan module 44 and the second filter module 45 may be accommodated In the second air flow space 414, and air may pass therethrough. The second compartment rib 416 may define a shape of the second air flow space 414 to accommodate the second fan module 44 and the second filter module 45. The second fan module 44 and the second filter module 45 may be mounted in the second air flow space 414. The second accommodating space 415 may include the circuit board 46 or a plurality of components including the circuit board 46.

The second cleaner body 41 may include a second fan module 44 and a second filter module 45. The second fan module 44 and the second filter module 45 may be disposed in the second air flow space 414 formed by the second compartment rib 416. The second fan module 44 may generate a suction force for sucking outside air. The second filter module 45 may filter foreign matter from the outside air sucked in by the second fan module 44. The second filter module 45 may be located upstream of the second fan module 44 based on the flow direction of air. The filtered air filtered by the second fan module 44 may pass through the second air flow hole 411*a* and flow into the second flow passage 124*b*. Further description of the second filter module 45 will be described with respect to FIGS. 9 and 10.

The second fan module 44 may have a body having a size that may be insertable into the second air flow space 414. The second fan module 44 may include a second fan 441 and a second fan motor 442. The second fan 441 may be coupled to the second fan motor 442, and may rotate by receiving power from the second fan motor 442. Air may be sucked in by the rotation of the second fan 441. The second fan 441 may be provided as a cross flow fan, an axial flow fan, a centrifugal fan, or the like. The second fan motor 442 may be provided as an AC motor, a DC motor, a BLDC motor, or the like.

The second fan module 44 may include a second inlet opening 443 and a second outlet opening 444. The second inlet opening 443 may be an inlet opening allowing external air to flow in a direction toward the second fan module 44. The second outlet opening 444 may be a discharge opening through which air introduced into the second inlet opening 443 is discharged. The air discharged through the second inflow opening 443 may flow into the second air flow hole 411*a*. The second inlet opening 443 may communicate with a plurality of second suction openings 421. The second outlet opening 444 may communicate with the second air flow hole 411*a*. When the second filter module 45 is positioned upstream of the second inlet opening 443, the filtered air flows from the second inlet opening 443 toward the second outlet opening 444.

The second cleaner body 41 may include the circuit board 46. The circuit board 46 may be disposed inside the second accommodation space 415. The circuit board 46 may control the operation of at least one of the first air cleaner 20 and the second air cleaner 40. The circuit board 46 may include a controller, a communication unit, an information storage unit, and the like. The controller may be a microprocessor, an integrated circuit, an electrical circuit, an electrical logic circuit, and the like. The communication unit may be a transmitter and/or a receiver. The information storage unit may be a semiconductor memory. When the operation signal is inputted from at least one of the first switch 222 and the second switch 422, the circuit board 46 may be activate at least one of the first air cleaner 20 and the second air cleaner 40.

The second cleaner body 41 may include a second locking hook 417. The second locking hook 417 may be provided in plurality. The second locking hook 417 may allow the second catching part 50 and the second cleaner body 41 to be coupled to each other. The second locking hook 417 may protrude from the side of the second cleaner body 41. The plurality of second locking hooks 417 may be located on the second side surface 41*b* and the third side surface 41*c* of the second cleaner body 41. A portion of the second locking hook 417 protruding outward may be bent in a direction toward the second protrusion 410. The second locking hook 417 may protrude outward from the second side surface 41*b* and the third side surface 41*c* and then be bent in a direction toward the first side surface 41*a*. The second locking hook 417 may be fixed to the second catching part 50 by the bent portion of the second locking hook 417, and separation of the second locking hook 417 from the second catching part 50 may be prevented.

The second cleaner body 41 may include a second opening 419. The second opening 419 may be an opening through which the second separation preventing strap 481 of the second separation preventing part 48 passes. The second opening 419 may be located on the first side surface 41*a*. The second opening 419 may be formed in a size corresponding to the second separation prevention strap 481. For example, one opening of the plurality of second openings 419 may be located near the second protrusion 410, and the other opening may be located near the second wire tube 413. The second wire tube 413 and the second protrusion 410 may be positioned between the one opening 419 and the other opening 419. The second air cleaner 40 may be easily folded with respect to the mask body 10 by the second separation preventing part 48 provided in the one opening 419 and the other opening 419.

The second cleaner body 41 may include a second cover fixing part 407. The second cover fixing part 407 may be for fixing the second cleaner cover 42 to the second cleaner body 41. In the present embodiment, the second cover fixing part 407 may be provided in the second cleaner body 41, but may be provided in the second cleaner cover 42. At least one of the second cleaner body 41 and the second cleaner cover 42 may have a second cover coupling part coupled to the second cover fixing part 407. The second cover fixing part 407 and the second cover coupling part may be located at positions corresponding to each other. The second cover fixing part 407 and the second cover coupling part may include a magnet member, a fastening member, and the like, and may be detachably coupled to each other.

The second air cleaner 40 may include a second cleaner cover 42. The second cleaner cover 42 may cover the second cleaner body 41. The second cleaner cover 42 may be detachably mounted on the opened upper surface of the second cleaner body 41 by the second cover fixing part 407 and the second cover coupling part. When the second cleaner cover 42 is mounted on the second cleaner body 41, the second cleaner cover 42 may contact the second compartment rib 416. When the second cleaner cover 42 is mounted to the second cleaner body 41, the inner space of the second cleaner body 41 may be partitioned into the second air flow space 414 and the second accommodation space 415.

The second cleaner cover 42 may include a second suction opening 421. The second suction opening 421 may be formed with a plurality of holes or may have a mesh shape at the second cleaner cover 42. Some of the plurality of second suction openings 421 may communicate the second air flow space 414. Those second suction openings 421 may be located above the second air flow space 414. The remaining of the plurality of second suction openings 421 may communicate with the second accommodation space 415. The remaining plurality of second suction openings 421 may be located above the second accommodation space 415. Air passing through the some of the plurality of second suction openings 421 may be sucked into the second air flow space 414. The second accommodation space 415 may be ventilated by the air flowing in or out through the remaining part of the plurality of second suction openings 421. Large foreign matter included in the outside air may be filtered by the second suction opening 421.

The second cleaner cover 42 may include a second switch 422. The second switch 422 may be exposed to the outer side of the second cleaner cover 42. The second switch 422 may be an operation switch for operating the second air cleaner 40. The second switch 422 may be provided as a power switch to turn on/off the second air cleaner 40. The second switch 422 may be used as an operation switch for controlling the operation of the second air cleaner 40 in accordance to the duration of the second switch 422 pressed, the number of times the second switch 422 is pressed, etc. In the present embodiment, the second switch 422 shows as being one, however, a plurality of switches may be provided as needed. The plurality of switches may also be referred to as a switch.

The second cleaner cover 42 may include a switch circuit board for driving the second switch 422. The switch circuit board may be located on an inner surface of the second cleaner cover 42 corresponding to the second accommodation space 415. When the second cleaner body 41 and the second cleaner cover 42 are coupled, the switch circuit board may be stored in the second accommodation space 415.

The second cleaner cover 42 may include a second mounting hook 427. The second mounting hook 427 may be for fixing the second cleaner cover 42 to the second cleaner body 41. A second hook mounting groove may be formed in the second cleaner cover 42 to mount the second mounting hook 427. The second cleaner cover 42 may be fixed to the second cleaner body 41 when the second mounting hook 427 is mounted in the second hook mounting groove. The second mounting hook 427 may allow the second cleaner cover 42 to be fixed to the second cleaner body 41 together with the second cover fixing part 407 and the second cover coupling part.

Figure 9:
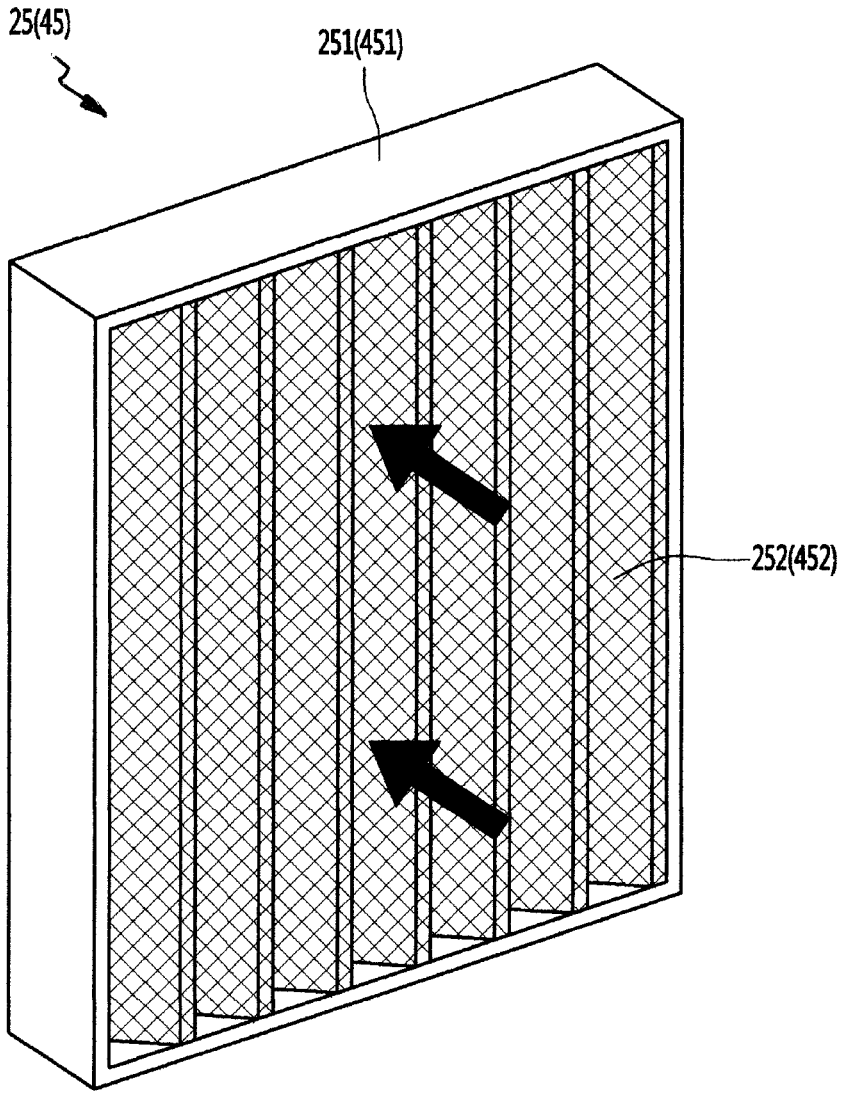
FIG. 9 is a perspective view of a filter module according to a first embodiment of the present invention.
Figure 10:
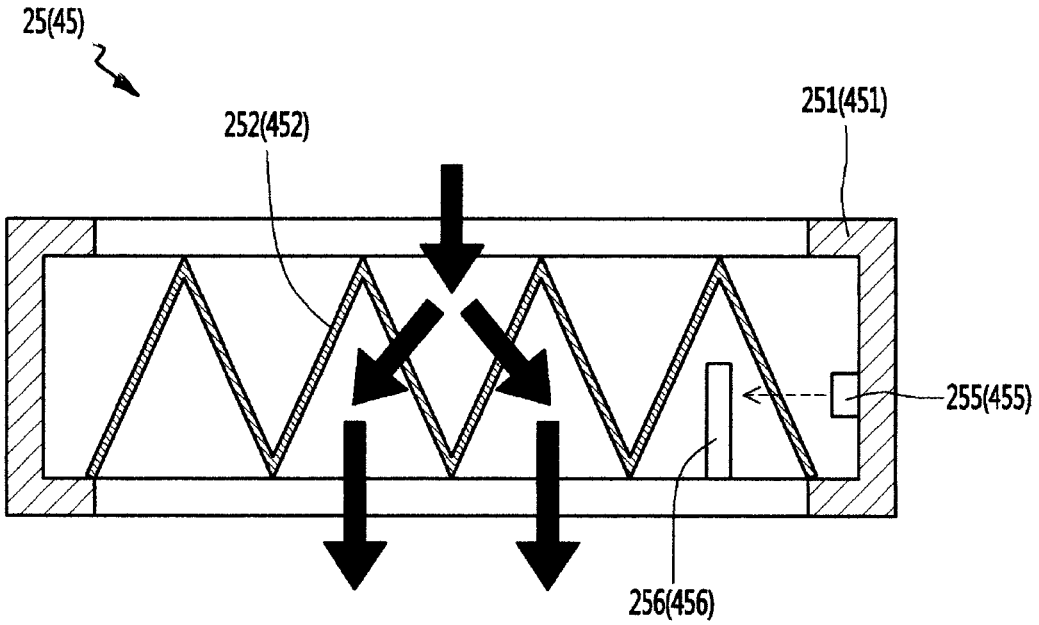
FIG. 10 is a cross-sectional view of the filter module according to the first embodiment of the present invention.

FIG. 9 is a perspective view of a filter module according to the first embodiment of the present invention, and FIG. 10 is a cross-sectional view of the filter module according to the first embodiment of the present invention.

Referring to FIGS. 9 and 10, the filter modules 25 and 45 according to the embodiment may be provided in the first air cleaner 20 and the second air cleaner 40. When the filter module 25 is provided in the first air cleaner 20, the filter module 25 may be referred to as a first filter module 25, and when the filter module 45 is provided in the second air cleaner 40, the second filter module 45 may be referred to as a second filter module 45. The filter modules 25 and 45 may filter the outside air sucked into the first air cleaner 20 and the second air cleaner 40, respectively. The air filtered by the filter modules 25 and 45 may be supplied to the user through the mask body 10.

The filter modules 25 and 45 may include filter module bodies 251 and 451. The filter module bodies 251 and 451 may form an outer appearance of the filter modules 25 and 45. The filter module bodies 251 and 451 may be inserted into the first air flow space 214 of the first air cleaner 20 and the second air flow space 414 of the second air cleaner 40, respectively. For example, the filter module bodies 251 and 451 may be formed as polygons, for example, squares, rectangles, and the like, in which one surface and the other surface are opened. Air may flow into the one surface of the filter module bodies 251 and 451, and flow out of the other surface of the filter module bodies 251 and 451.

The filter modules 25 and 45 may include filter parts 252 and 452. The filter parts 252 and 452 may be located inside the filter module bodies 251 and 451. The filter parts 252 and 452 may be positioned between the opened one surface and the opened other surface of the filter module bodies 251 and 451. The filter parts 252 and 452 may filter foreign substances from the outside air introduced into the one surface of the filter module bodies 251 and 451. The air filtered by the filter parts 252 and 452 may be discharged to the other surfaces of the filter module bodies 251 and 451. The filter parts 252 and 452 may be formed in a flat, curved, zigzag, bent shape, or the like. In the present embodiment, the filter parts 252 and 452 are formed in a zigzag shape. When the filter parts 252 and 452 are formed in a zigzag shape, the filtration area for filtering the outside air inside the filter module bodies 251 and 451 may be increased, and the filtering efficiency may be improved.

The filter modules 25 and 45 may include light emitters 255 and 455 and light receivers 256 and 456. The light emitters 255 and 455 and the light receivers 256 and 456 may be life detection sensors for checking the life of the filter parts 252 and 452. The light emitters 255 and 455 may be disposed on one side of the filter parts 252 and 452, and the light receivers 256 and 456 may be located on the other side of the filter parts 252 and 452. The light emitters 255 and 455 may radiate light. The light irradiated from the light emitters 255 and 455 may include light that may pass through the filter parts 252 and 452, and may be laser light, and the like. The light receivers 256 and 456 may receive light emitted from the light emitters 255 and 455. The life of the filter parts 252 and 452 may be determined by the amount of light received by the light receivers 256 and 456. When the amount of light received by the light receivers 256 and 456 is lower than a predetermined amount, a large number of foreign substances may be attached to the filter parts 252 and 452 to reduce the transmission of light. When the filter parts 252 and 452 have reached its life span, the controller may display a message in a display and/or by audio through a speaker that the filter parts 252 and 452 have to be replaced.

The filter parts 252 and 452 may be a hepa filter, a deodorization filter, an antibacterial filter, a charging filter, combination thereof, and the like. When the filter parts 252 and 452 are provided as charging filters, the filter parts 252 and 452 may operate by receiving power from the battery 26. The filter parts 252 and 452 may be provided as a composite filter in which a plurality of filters are combined. The filter parts 252 and 452 may be provided for single use or may be washable and to be mounted and detached from the filter module bodies 251 and 451.

According to the embodiment, it may be possible to easily determine the life of the filter modules 25 and 45 through the life detection sensor. It may be possible to clean the filter parts 252 and 452 or replace the filter parts 252 and 452 by identifying the life of the filter modules 25 and 45.

Figure 11:
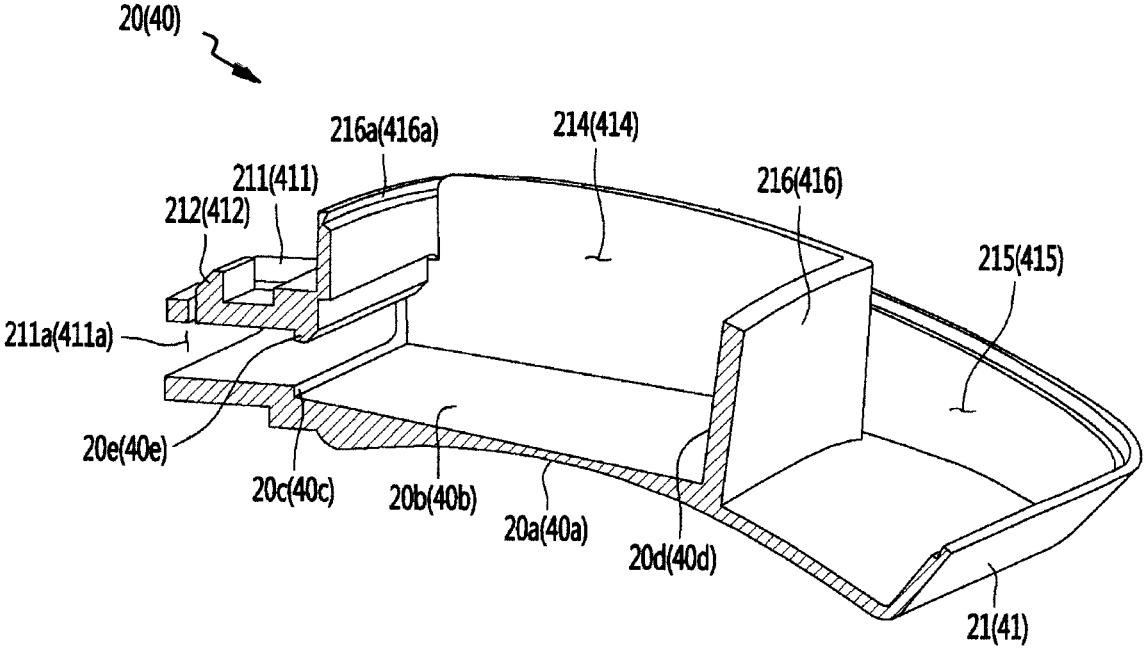
FIG. 11 is a cross-sectional view of a cleaner body according to the first embodiment of the present invention.
Figure 12:
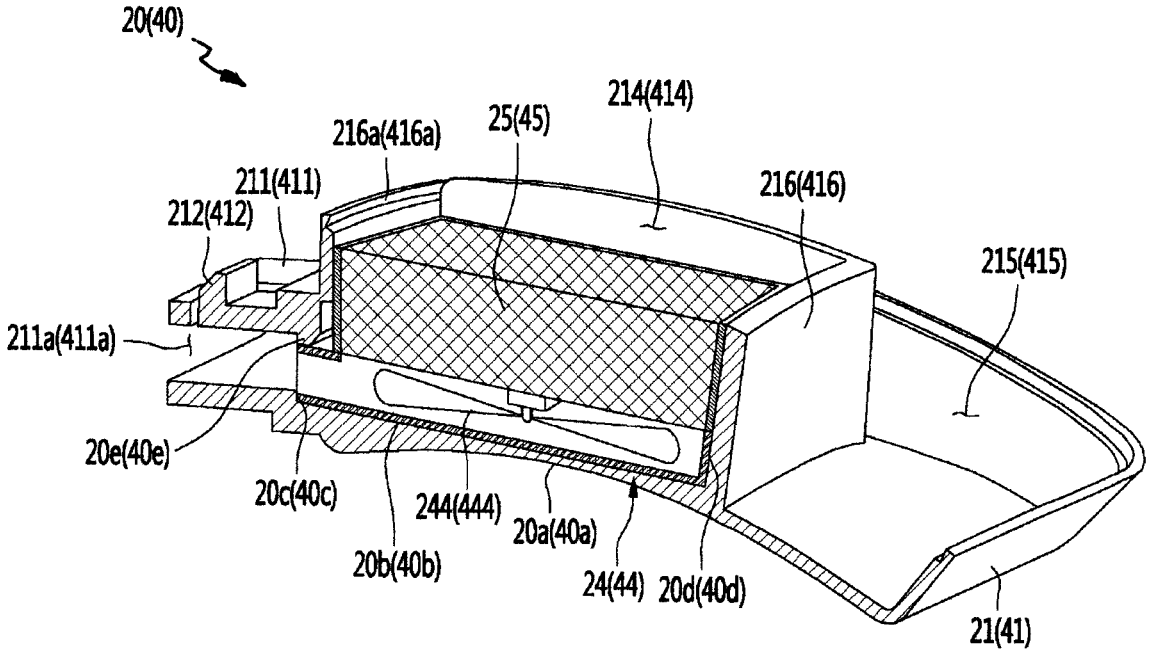
FIG. 12 is a view showing a fan module and the filter module mounted on the cleaner body according to the first embodiment of the present invention.

FIG. 11 is a cross-sectional view of the cleaner body according to the first embodiment of the present invention, and FIG. 12 is a view showing the fan module and the filter module mounted on the cleaner body according to the first embodiment of the present invention.

Referring to FIGS. 11 and 12, the first air cleaner 20 may include the first cleaner body 21, and the second air cleaner 40 may include the second cleaner body 41. Hereinafter, the first cleaner body 21 and the second cleaner body 41 may be referred to as cleaner bodies 21 and 41, and details of the cleaner bodies 21 and 41 will now be described.

The compartment ribs 216 and 416 of the cleaner bodies 21 and 41 may include hook mounting grooves 216*a* and 416*a*. The hook mounting grooves 216*a* and 416*a* may be grooves in which one side of the cleaner covers 22 and 42 may be fixed. The hook mounting grooves 216*a* and 416*a* may be located on the first side surfaces 21*a* and 41*a* of the cleaner bodies 21 and 41. For example, the first and second mounting hooks 227 and 427 of the cleaner covers 22 and 42 may be fixed to the hook mounting grooves 216*a* and 416*a*.

The cleaner bodies 21 and 41 may include curved surfaces 20*a* and 40*a*. The curved surfaces 20*a* and 40*a* may be part of bottom surfaces of the cleaner bodies 21 and 41. The bottom surfaces of the cleaner bodies 21 and 41 may include an outer surface facing the user's face and an inner surface forming a seating surface of the cleaner bodies 21 and 41. The curved surfaces 20*a* and 40*a* may be provided on the outer surface. The curved surfaces 20*a* and 40*a* may be formed as curved surfaces having a constant curvature. The curved surfaces 20*a* and 40*a* may face the user's face when the cleaner bodies 21 and 41 are mounted on the user's face. When the mask device 1 is mounted on the user's face, the curved surfaces 20*a* and 40*a* may be in close contact with the user's face.

The cleaner bodies 21 and 41 may include seating surfaces 20*b* and 40*b*. The seating surfaces 20*b* and 40*b* may be the inner surfaces of the cleaner bodies 21 and 41. The seating surfaces 20*b* and 40*b* may be surfaces on which the fan modules 24 and 44 and the filter modules 25 and 45 are seated in this embodiment. The seating surfaces 20*b* and 40*b* may be provided as a flat surface to support the fan modules 24 and 44 and the filter modules 25 and 45. In the present embodiment, the fan modules 24 and 44 are seated on the seating surfaces 20*b* and 40*b*. Alternatively, the filter modules 25 and 45 are seated on the seating surfaces 20*b* and 40*b*.

The seating surfaces 20*b* and 40*b* may further include a plurality of support protrusions. The plurality of support protrusions may be formed to protrude from the seating surfaces 20*b* and 40*b*. The plurality of support protrusions may allow any one of the fan modules 24 and 44 and the filter modules 25 and 45 to be spaced apart from the seating surfaces 20*b* and 40*b*. A separation space through which air passes may be formed between the seating surfaces 20*b* and 40*b* and any one of the fan modules 24 and 44 and the filter modules 25 and 45. The formed space may be in communication with the air flow holes 211*a* and 411*a*.

The cleaner bodies 21 and 41 may include support surfaces 20*c* and 40*c*. The support surfaces 20*c* and 40*c* may be located at one side of the seating surfaces 20*b* and 40*b*. The support surfaces 20*c* and 40*c* may contact side surfaces of the fan modules 24 and 44 seated on the mounting surfaces 20*b* and 40*b*. The support surfaces 20*c* and 40*c* may contact side surfaces of the fan modules 24 and 44 seated on the seating surfaces 20*b* and 40*b* to support the side surfaces of the fan modules 24 and 44. The support surfaces 20*c* and 40*c* may be provided in plural to support side surfaces of the fan modules 24 and 44. The support surfaces 20*c* and 40*c* may be located at least on the first side surfaces 21*a* and 41*a*. The support surfaces 20*c* and 40*c* may be disposed adjacent to fixing protrusions 20*e* and 40*e* to support side surfaces of the fan modules 24 and 44 seated on the seating surfaces 20*b* and 40*b*. The support surfaces 20*c* and 40*c* may be recessed in the direction toward the ducts 211 and 411 in the first side surfaces 21*a* and 41*a* so that a part of the fan modules 24 and 44 may be inserted.

The cleaner bodies 21 and 41 may include guide surfaces 20*d* and 40*d*. The guide surfaces 20*d* and 40*d* may be located at side surfaces coupled to seating surfaces 20*b* and 40*b*. The guide surfaces 20*d* and 40*d* may be located on the fourth side surfaces 21*d* and 41*d*. The guide surfaces 20*d* and 40*d* may be in contact with side surfaces of the fan modules 24 and 44 seated on the seating surfaces 20*b* and 40*b*. The guide surfaces 20*d* and 40*d* may be in contact with side surfaces of the fan modules 24 and 44 seated on the seating surfaces 20*b* and 40*b* to support the side surfaces of the fan modules 24 and 44. The guide surfaces 20*d* and 40*d* may be formed on inner surfaces of the partition ribs 216 and 416. The guide surfaces 20*d* and 40*d* may guide the direction in which the side surfaces of the fan modules 24 and 44 move into the cleaner bodies 21 and 41 when the fan modules 24 and 44 are inserted into the air flow spaces 214 and 414.

When the fan modules 24 and 44 are mounted in the air flow spaces 214 and 414, the fan modules 24 and 44 may be in contact with one side of the fan modules 24 and 44 in contact with the support surfaces 20*c* and 40*c*. The other side of the fan modules 24 and 44 may be in contact with the guide surfaces 20*d* and 40*d*. The fan modules 24 and 44 may be seated on the seating surfaces 20*b* and 40*b* by inserting the fan modules 24 and 44 inclined in the direction toward the seating surfaces 20*b* and 40*b*. The guide surfaces 20*d* and 40*d* may guide the moving directions of the fan modules 24 and 44 that are then pressed in. The fan modules 24 and 44 disposed between the support surfaces 20*c* and 40*c* and the guide surfaces 20*d* and 40*d* may be stably fixed inside the air flow spaces 214 and 414. In the present embodiment, the support surfaces 20*c* and 40*c* and the guide surfaces 20*d* and 40*d* may restrict the movement of the fan modules 24 and 44 in the left and right directions.

The cleaner bodies 21 and 41 may include fixing protrusions 20*e* and 40*e*. The fixing protrusions 20*e* and 40*e* may be disposed on the seating surfaces 20*b* and 40*b* and may contact a part of the fan modules 24 and 44 which are in contact with the support surfaces 20*c* and 40*c*. The fixing protrusions 20*e* and 40*e* may contact a part of the fan modules 24 and 44 to support the part of the fan modules 24 and 44. In this embodiment, the support surfaces 20*c* and 40*c* are disposed at one side of the air flow holes 211*a* and 411*a*, and the fixing protrusions 20*e* and 40*e* are disposed at the other side of the air flow holes 211*a* and 411*a*. A part of the fixing protrusions 20*e* and 40*e* may be inclined. When a part of the fixing protrusions 20*e* and 40*e* is formed to be inclined, when the fan modules 24 and 44 are mounted on the seating surfaces 20*b* and 40*b* in an inclined state, interference by the fixing protrusions 20*e* and 40*e* may be minimized. Once the fan modules 24 and 44 are inserted, the fixing protrusions 20*e* and 40*e* may limit the movement of the fan modules 24 and 44 in the vertical direction.

Hereinafter, a process in which the fan modules 24 and 44 and the filter modules 25 and 45 are mounted in the air flow spaces 214 and 414 will be described. The fan modules 24 and 44 and the filter modules 25 and 45 may be mounted on the air flow spaces 214 and 414 of the cleaner bodies 21 and 41. After the fan modules 24 and 44 and the filter modules 25 and 45 are mounted, the cleaner covers 22 and 42 are covered on the cleaner bodies 21 and 41 to cover the fan modules 24 and 44 and the filter modules 25 and 45 and to prevent them from falling out.

The fan modules 24 and 44 may be seated on seating surfaces 20*b* and 40*b* of the cleaner bodies 21 and 41. When the fan modules 24 and 44 are seated on the seating surfaces 20*b* and 40*b*, one side of the fan modules 24 and 44 is supported by the support surfaces 20*c* and 40*c*, and the other side of the fan modules 24 and 44 may be supported by the guide surfaces 20*d* and 40*d*.

The fan modules 24 and 44 may be inserted inclined toward the air flow spaces 214 and 414. One side of the fan modules 24 and 44 comes in contact with the support surfaces 20*c* and 40*c*, and the other side of the fan modules 24 and 44 is guided along the guide surfaces 20*d* and 40*d*. The fan modules 24 and 44 may then be pressed to be fixed to the seating surfaces 20*b* and 40*b*. The fixing protrusions 20*e* and 40*e* may come into contact with a part of the fan modules 24 and 44 while one side of the fan modules 24 and 44 comes in contact with the support surfaces 20*c* and 40*c*. The fixing protrusions 20*e* and 40*e* may prevent the fan modules 24 and 44 from moving in the vertical direction. When the fan modules 24 and 44 are seated on the seating surfaces 20*b* and 40*b*, the outlet openings 244 and 444 of the fan modules 24 and 44 may communicate with air flow holes 211*a* and 411*a*.

After the fan modules 24 and 44 are mounted in the air flow spaces 214 and 414, the filter modules 25 and 45 may be mounted above the fan modules 24 and 44. The outside air may be supplied to the mask body 10 after sequentially passing through the filter modules 25 and 45 and the fan modules 24 and 44. Since the filter modules 25 and 45 are disposed upstream of the fan modules 24 and 44 based on the flow direction of the air, the air filtered by the filter modules 25 and 45 may then be supplied to the mask body 10.

By the structure of the present embodiment, the fan modules 24 and 44 may be stably fixed to the cleaner bodies 21 and 41. Since the fan modules 24 and 44 are firmly fixed, vibration noise of the fan modules 24 and 44 may be minimized. Replacement of the filter modules 25 and 45 may be made easily. The fan modules 24 and 44 may be prevented from easily falling off from the cleaner bodies 21 and 41.

Figure 13:
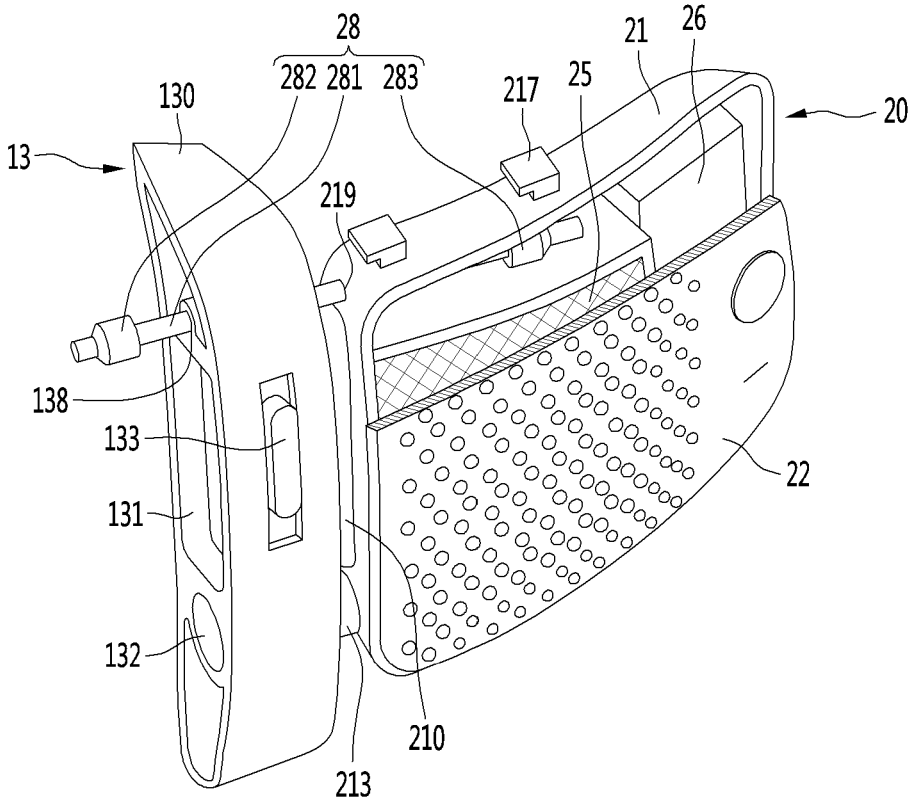
FIG. 13 is a view showing the first air cleaner fixed to a first fixing part according to the first embodiment of the present invention.
Figure 14:
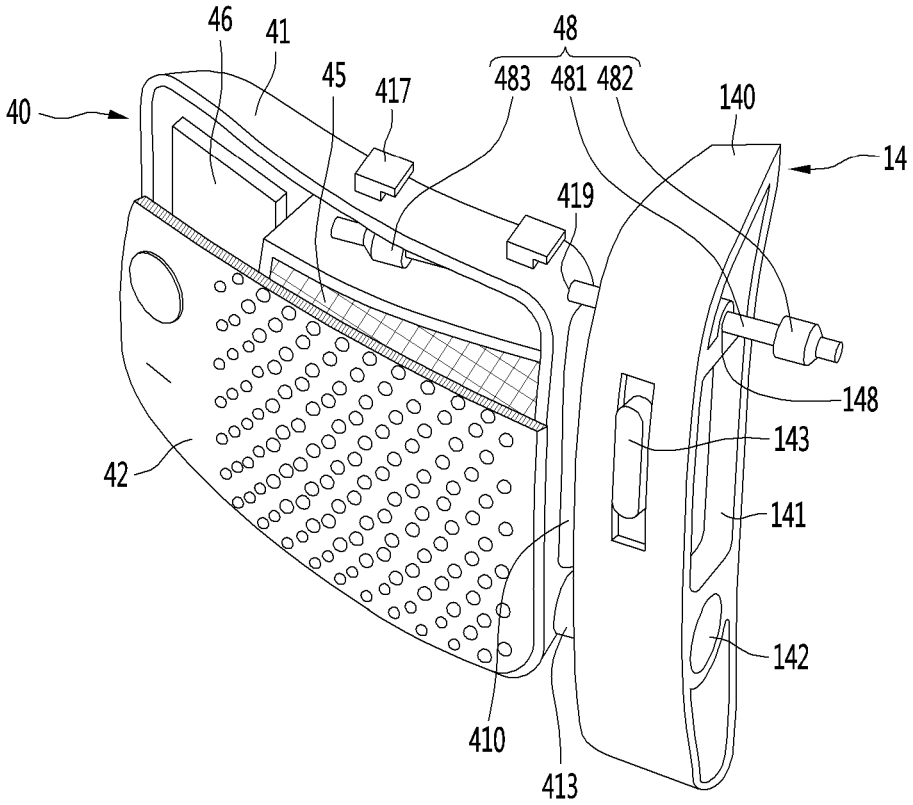
FIG. 14 is a view showing the second air cleaner fixed to a second fixing part according to the first embodiment of the present invention.

FIG. 13 is a view showing the first air cleaner fixed to the first fixing part according to the first embodiment of the present invention, and FIG. 14 is a view showing the second air cleaner fixed to the second fixing part according to the first embodiment of the present invention.

The mask body 10 according to the present embodiment may include the first fixing part 13 and the second fixing part 14. The first fixing part 13 and the second fixing part 14 may allow the first air cleaner 20 and the second air cleaner 40 to be coupled to the mask body 10. The first air cleaner 20 may be movably coupled to the first fixing part 13, and the second air cleaner 40 may be movably coupled to the second fixing part 14.

Referring to FIG. 13, the first fixing part 13 may include a first fixing body 130 forming a body. The first fixing body 130 may be fixed to the mask body 10. The first fixing body 130 may be fixed between the front cover 12 and the frame 11. The first fixing body 130 may be inserted into and fixed to the first fixing recess 129*a* of the mask body 10. When the first fixing part 13 is fixed to the first fixing recess 129*a*, one side of the first flow passage 124*a* and on one side of the third flow passage 124*c* may be shielded.

The first fixing body 130 may include a first duct insertion hole 131. The first duct insertion hole 131 may be an opening into which the first duct 211 of the first air cleaner 20 is inserted. When the first duct 211 is inserted into the first duct insertion hole 131, the first cleaner body 21 may be fixed to the first fixing body 130. The first duct insertion hole 131 may be formed in a shape corresponding to the first duct 211. When the first duct 211 is inserted into the first duct insertion hole 131, the first flow passage 124*a* of the mask body 10 and the first air flow hole 211*a* of the first duct 211 may be in communication with each other. The first duct insertion hole 131 may be formed by opening a portion of the first fixing body 130.

When the first fixing part 13 and the first cleaner body 21 are coupled to each other, one surface of the first fixing body 130 and the first protrusion 210 of the first cleaner body 21 may be in contact with each other. When the first protrusion 210 contacts one surface of the first fixing body 130, the first duct 211 may be inserted into the first duct insertion hole 131 and the coupling may be sealingly made. The first protrusion 210 may be positioned between the first fixing part 13 and the first cleaner body 21 to form a space in which a part of the first catching part 30 may be disposed.

The first fixing body 130 may include a first wire tube insertion hole 132. The first wire tube insertion hole 132 may be an opening into which the first wire tube 213 of the first air cleaner 20 may be inserted. The first wire tube insertion hole 132 may be formed in a shape corresponding to the first wire tube 213. When the first wire tube 213 is inserted into the first wire tube insertion hole 132, the third flow passage 124*c* of the mask body 10 and the first wire passage hole 213*a* of the first wire tube 213 may be in communication with each other. The first wire tube insertion hole 132 may be formed by opening a portion of the first fixing body 130.

The first fixing body 130 may include a first fixing hook release part 133. The first fixing hook release part 133 may be located at one side of the first fixing body 130. For example, the first fixing hook release part 133 may be located at one side of the first fixing body 130 that faces the front cover 12. The first fixing hook release part 133 may be exposed to the outside environment by passing through a portion of the front cover 12 when the front cover 12 and the frame 11 are coupled to each other (see FIG. 1). An opening may be formed in the front cover 12 to expose the first fixing hook release part 133 to the outside environment. When the first fixing hook release part 133 is operated, the first air cleaner 20 fixed to the first fixing part 13 may be separated. The first fixing hook release part 133 may release the first fixing hook 212 fixed to the first fixing part 13. For example, the first fixing hook release part 133 may be provided as a button. When the button is pressed, the first fixing hook release part 133 applies an external force to the first fixing hook 212 so as to be released from the first fixing part 13. The first fixing hook 212 may separate from the first fixing part 13.

The first fixing body 130 may include a third opening 138. The third opening 138 may be formed by opening a portion of the first fixing body 130. The third opening 138 may be an opening through which the first separation preventing strap 281 of the first separation preventing part 28 passes. The third opening 138 may be formed in a size such that the first separation preventing strap 281 may be located inside. The third opening 138 may prevent the first separation preventing protrusion 282 from being separated from the first fixing part 13. The third opening 138 may be formed to have a diameter larger than the diameter of the first separation preventing strap 281 and smaller than the diameter of the first separation preventing protrusion 282. The first separation preventing protrusion 282 may be prevented from separating at one side of the first fixing part 13 after passing through the third opening 138.

The mask device 1 may include the first separation preventing part 28 coupling the first fixing part 13 and the first air cleaner 20. The first separation preventing part 28 may be provided in plurality.

The first separation prevention part 28 may include the first separation preventing strap 281, the first separation preventing protrusion 282, and a second separation preventing protrusion 283. The first separation preventing strap 281 may extend in the longitudinal direction. The first separation preventing protrusion 282 may be provided at one end of the first separation preventing strap 281, and the second separation preventing protrusion 283 may be provided at the other end of the first separation preventing strap 281. The first separation preventing protrusion 282 and the second separation preventing protrusion 283 may have a larger diameter or larger size than the first separation preventing strap 281.

The first separation preventing strap 281 may pass through the first opening 219 at the first cleaner body 21 and the third opening 138 at the first fixing part 13. The first separation preventing protrusion 282 may be located at one side of the first fixing part 13, and the second separation preventing protrusion 283 may be located at one side of the first cleaner body 21. The first separation preventing protrusion 282 may limit the separation from the first fixing part 13. The second separation preventing protrusion 283 may limit the separation from the first cleaner body 21. At least one of the first separation preventing protrusion 282 and the second separation preventing protrusion 283 may be released from at least one of the first fixing part 13 and the first cleaner body 21.

In another embodiment, the first separation preventing part 28 may be located in the first wire tube insertion hole 132 and the first wire passage hole 213*a*. In this case, the first separation preventing protrusion 282 and the second separation preventing protrusion 283 may be formed to have a size that may be caught in the first wire tube insertion hole 132 and the first wire passage hole 213*a*. The first separation preventing protrusion 282 and the second separation preventing protrusion 283 may be caught by the first wire tube insertion hole 132 and the first wire passage hole 213*a*, respectively, so that the release of the first fixing part 13 from the first cleaner body 21 may be limited.

Referring to FIG. 14, the second fixing part 14 may include a second fixing body 140 forming a body. The second fixing body 140 may be fixed to the mask body 10. The second fixing body 140 may be fixed between the front cover 12 and the frame 11. The second fixing body 140 may be inserted into and fixed to the second fixing recess 129*b* of the mask body 10. When the second fixing part 14 is fixed to the second fixing part mounting groove 129*b*, one side of the second flow passage 124*b* and the other side of the third flow passage 124*c* may be shielded.

The second fixing body 140 may include a second duct insertion hole 141. The second duct insertion hole 141 may be an opening into which the second duct 411 of the second air cleaner 40 is inserted. When the second duct 411 is inserted into the second duct insertion hole 141, the second cleaner body 41 may be fixed to the second fixing body 140. The second duct insertion hole 141 may be formed in a shape corresponding to the second duct 411. When the second duct 411 is inserted into the second duct insertion hole 141, the second flow passage 124*b* of the mask body 10 and the second air flow hole 411*a* of the second duct 411 may be in communication with each other. The second duct insertion hole 141 may be formed by opening a portion of the second fixing body 140.

When the second fixing part 14 and the second cleaner body 41 are coupled to each other, one surface of the second fixing body 140 and the second protrusion 410 of the second cleaner body 41 may be in contact with each other. When the second protrusion 410 contacts one surface of the second fixing body 140, the second duct 411 may be inserted into the second duct insertion hole 141 and the coupling may be sealingly made. The second protrusion 410 may be positioned between the second fixing part 14 and the second cleaner body 41 to form a space in which a part of the second catching part 50 may be disposed.

The second fixing body 140 may include a second wire tube insertion hole 142. The second wire insertion hole 142 may be an opening into which the second wire tube 413 of the second air cleaner 40 may be inserted. The second wire tube insertion hole 142 may be formed in a shape corresponding to the second wire tube 413. When the second wire tube 413 is inserted into the second wire tube insertion hole 142, the third flow passage 124*c* of the mask body 10 and the second wire passage hole 413*a* of the second wire tube 413 may be in communication with each other. The second wire tube insertion hole 142 may be formed by opening a portion of the second fixing body 140.

The second fixing body 140 may include a second fixing hook release part 143. The second fixing hook release part 143 may be located at one side of the second fixing body 140. For example, the second fixing hook release part 143 may be located at one side of the first fixing body 130 facing the front cover 12. The second fixing hook release part 143 may be exposed to the outside environment by passing through a portion of the front cover 12 when the front cover 12 and the frame 11 are coupled to each other (see FIG. 2). An opening may be formed in the front cover 12 to expose the second fixing hook release part 143 to the outside environment. When the second fixing hook release part 143 is operated, the second air cleaner 40 fixed to the second fixing part 14 may be separated. The second fixing hook release part 143 may release the second fixing hook 412 fixed to the second fixing part 14. For example, the second fixing hook release part 143 may be provided as a button. When the button is pressed, the second fixing hook release part 143 applies an external force to the second fixing hook 412 so as to be released from the second fixing part 14. The second fixing hook 412 may separate from the second fixing part 14.

The second fixing body 140 may include a fourth opening 148. The fourth opening 148 may be formed by opening a portion of the second fixing body 140. The fourth opening 148 may be an opening through which the second separation preventing strap 481 of the second separation preventing part 48 passes. The fourth opening 148 may be formed in a size such that the second separation prevention strap 481 may be located inside. The fourth opening 148 may prevent the third separation preventing protrusion 482 from being separated from the second fixing part 14. The fourth opening 148 may be formed to have a diameter larger than the diameter of the second separation preventing strap 481 and smaller than the diameter of the third separation preventing protrusion 482. The third separation preventing protrusion 482 may be prevented from separating at one side of the second fixing part 14 after passing through the fourth opening 148.

The mask device 1 may include a second separation preventing part 48 coupling the second fixing part 14 and the second air cleaner 40. The second separation preventing part 48 may be provided in plurality.

The second separation prevention part 48 may include a second separation prevention strap 481, a third separation prevention protrusion 482, and a fourth separation prevention protrusion 483. The second separation prevention strap 481 may extend in the longitudinal direction. The third separation prevention protrusion 482 may be provided at one end of the second separation prevention strap 481, and the fourth separation prevention protrusion 483 may be provided at the other end of the second separation prevention strap 481. The third separation preventing protrusion 482 and the fourth separation preventing protrusion 483 may have a larger diameter or larger size than the second separation preventing strap 481.

The second separation preventing strap 481 may pass through the second opening 419 at the second cleaner body 41 and the fourth opening 148 at the second fixing part 14. The third separation prevention protrusion 482 may be located at one side of the second fixing part 14, and the fourth separation prevention protrusion 483 may be located at one side of the second cleaner body 41. The third separation preventing protrusion 482 may limit the separation from the second fixing part 14. The fourth separation preventing protrusion 483 may limit the separation from the second cleaner body 41. At least one of the third separation preventing protrusion 482 and the fourth separation preventing protrusion 483 may be released from at least one of the second fixing part 14 and the second cleaner body 41.

In another embodiment, the second separation preventing part 48 may be located in the second wire tube insertion hole 142 and the second wire passage hole 413*a*. In this case, the third separation preventing protrusion 482 and the fourth separation preventing protrusion 483 may be formed to have a size that may be caught by the second wire tube insertion hole 142 and the second wire passing hole 413*a*. The third separation preventing protrusion 482 and the fourth separation preventing protrusion 483 may be caught by the second wire tube insertion hole 142 and the second wire passage hole 413*a*, respectively, so that the release of the second fixing part 14 and the second cleaner body 41 may be limited.

Figure 15:
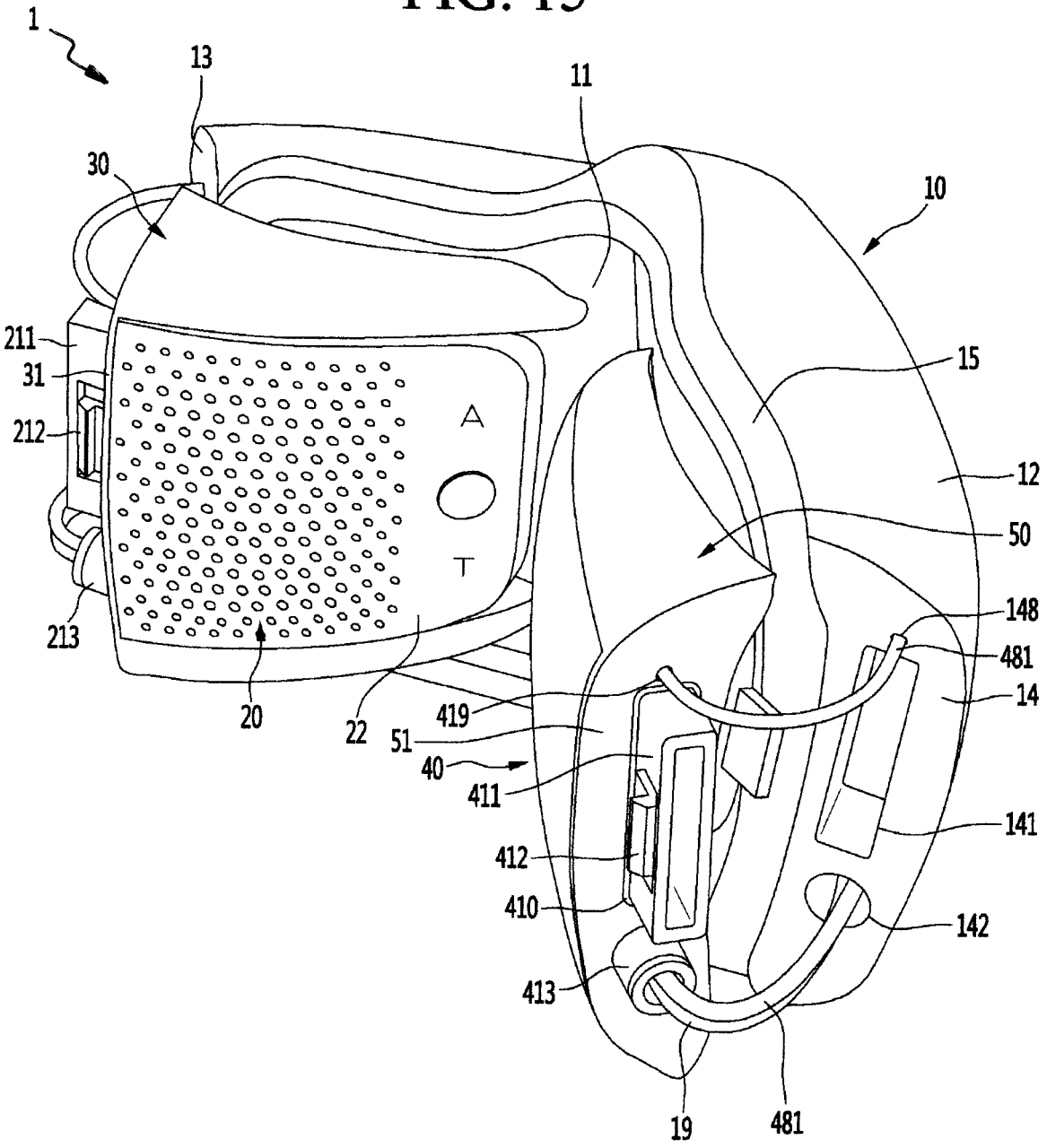
FIG. 15 is a view showing a folded state of the mask device according to the first embodiment of the present invention.

FIG. 15 is a view showing a folded state of the mask device according to the first embodiment of the present invention.

Referring to FIG. 15, in the mask device 1 according to the embodiment, the first air cleaner 20 and the second air cleaner 40 may be folded with respect to the mask body 10. When the mask device 1 is being used, the first air cleaner 20 and the second air cleaner 40 may be fixed to both end portions of the mask body 10. The user's face may be located between the first air cleaner 20 and the second air cleaner 40 fixed to both end portions of the mask body 10.

The first fixing part 13 of the mask body 10 may include the first duct insertion hole 131 and the first wire tube insertion hole 132. When the first air cleaner 20 is fixed to the first fixing part 13, the first duct 211 of the first air cleaner 20 may be inserted into the first duct insertion hole 131. The first wire tube 213 may be inserted into the first wire tube insertion hole 132. When the first duct 211 and the first wire tube 213 are inserted, the first protrusion 210 of the first air cleaner 20 may contact the first fixing part 13 to limit the amount the first duct 211 may be inserted into the first duct insertion hole 131. When the first duct 211 is inserted into the first duct insertion hole 131, the first fixing hook 212 of the first air cleaner 20 may lock to the first fixing part 13. A part of the first catching part 30 is disposed between the first air cleaner 20 and the first fixing part 13, and the mask device may be mounted on the user's face by the first catching part 30.

The second fixing part 14 of the mask body 10 may include the second duct insertion hole 141 and the second wire tube insertion hole 142. When the second air cleaner 40 is fixed to the second fixing part 14, the second duct 411 of the second air cleaner 40 may be inserted into the second duct insertion hole 141. The second wire tube 413 may be inserted into the second wire tube insertion hole 142. When the second duct 411 and the second wire tube 413 are inserted, the second protrusion 410 of the second air cleaner 40 may contact the second fixing part 14 to limit the amount of the second duct 411 may be inserted into the second duct insertion hole 141. When the second duct 411 is inserted into the second duct insertion hole 141, the second fixing hook 412 of the second air cleaner 40 may lock to the second fixing part 14. A part of the second catching part 50 is disposed between the second air cleaner 40 and the second fixing part 14, and a mask device may be mounted on the user's face by the second catching part 50.

When the mask device 1 is not used, the first air cleaner 20 and the second air cleaner 40 may be folded with respect to the mask body 10. When the first air cleaner 20 and the second air cleaner 40 are folded, the first air cleaner 20 and the second air cleaner 40 may cover the frame 11 of the mask body 10. The first air cleaner 20 may be folded by rotating at the left end of the mask body 10 in a direction toward the frame 11. The second air cleaner 40 may be folded by rotating at the right end of the mask body 10 in the direction toward the frame 11. In the present embodiment, the first air cleaner 20 and the second air cleaner 40 may be rotatably coupled to the mask body 10 by the first separation preventing part 28 and the second separation preventing part 48 to close a part of the breathing space of the mask body 10 covering the user's nose and mouth. Thus, by closing the part of the breathing space of the mask body 10 from the outside environment, exposure to contamination may be minimized.

When the first fixing hook release part 133 of the first fixing part 13 is operated, the first fixing hook 212 that is locked to the first fixing part 13 may be released. When the first fixing hook 212 is released, the first duct 211 may be separated from the first fixing part 13. The first cleaner body 21 separated from the first fixing part 13 may be rotated in a direction toward the frame 11. Since the first fixing part 13 and the first cleaner body 21 are coupled to each other by the first separation preventing part 28, the first fixing part 13 and the first cleaner body 21 may be limited in being spaced apart by a predetermined distance or less.

When the second fixing hook release part 143 of the second fixing part 14 is operated, the second fixing hook 412 that is locked to the second fixing part 14 may be released. When the second fixing hook 412 is released, the second duct 411 may be separated from the second fixing part 14. The second cleaner body 41 separated from the second fixing part 14 may be rotated in a direction toward the frame 11. Since the second fixing part 14 and the second cleaner body 41 are coupled to each other by the second separation preventing part 48, the second fixing part 14 and the second cleaner body 41 may be limited in being spaced apart by a predetermined distance or less.

In the present embodiment, the first air cleaner 20 and the second air cleaner 40 are connected to the mask body 10 by the first separation preventing part 28 and the second separation preventing part 48, and described as being rotated toward and folded. However, in another embodiment, a hinge may be provided between the first air cleaner 20 and the first fixing part 13, and a hinge may be provided between the second air cleaner 40 and the second fixing part 14. The first air cleaner 20 and the second air cleaner 40 may be rotated and folded with respect to the mask body 10 by the hinges.

Figure 16:
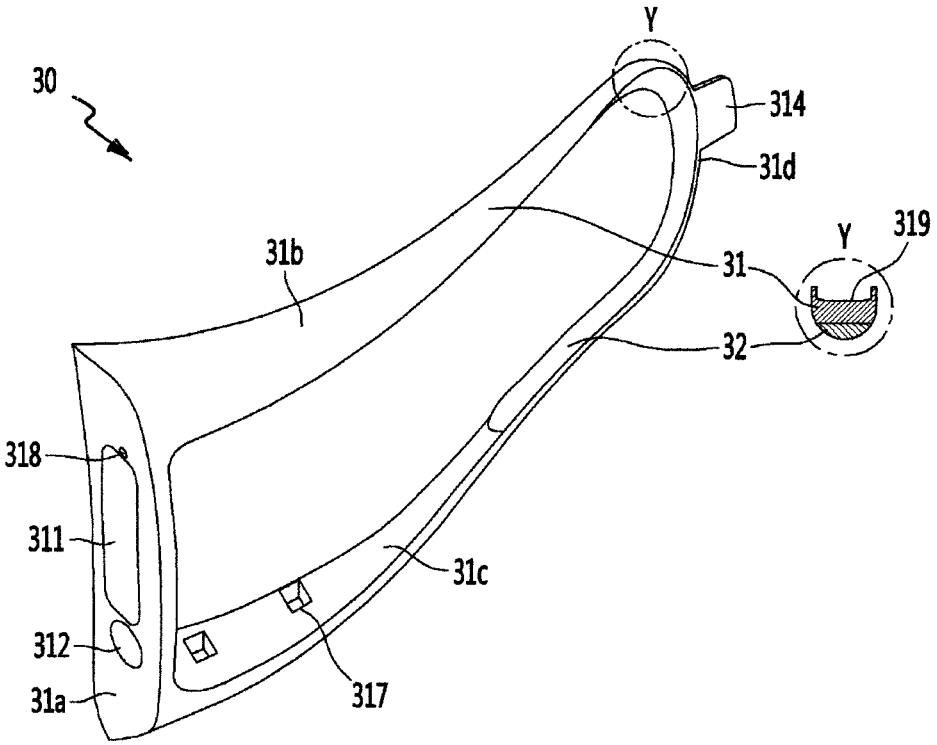
FIG. 16 is a view showing a first catching part according to the first embodiment of the present invention.
Figure 17:
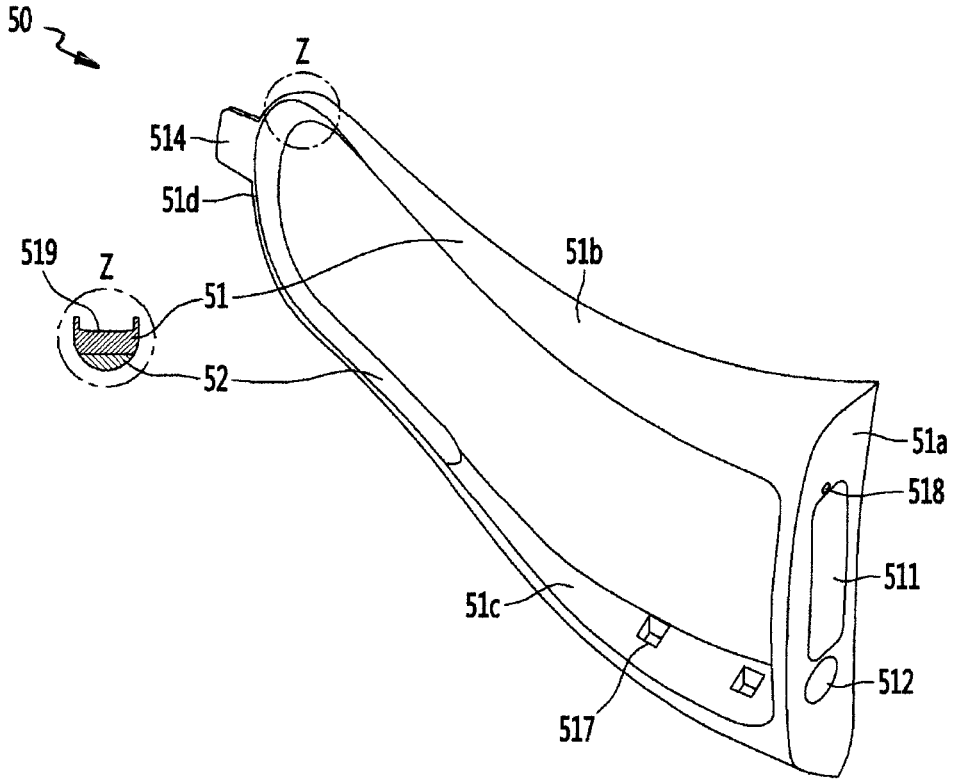
FIG. 17 is a view showing a second catching part according to the first embodiment of the present invention.

FIG. 16 is a view showing the first catching part according to the first embodiment of the present invention, and FIG. 17 is a view showing the second catching part according to the first embodiment of the present invention.

Referring to FIGS. 16 and 17, the mask device 1 according to the embodiment may include the first catching part 30 and the second catching part 50. The first catching part 30 may be detachably mounted to the first air cleaner 20, and the second catching part 50 may be detachably mounted to the second air cleaner 40. The first catching part 30 and the second catching part 50 may allow the first air cleaner 20 and the second air cleaner 40 to be supported by the user's ears. For example, the first catching part 30 and the second catching part 50 may be formed in a ring shape that is fixed to the user's ears. The first catching part 30 and the second catching part 50 may be formed in a leg shape to be fixed to a part of the user's ears. The leg may be formed in a structure such as a pair of glasses that are fastened to a part of the user's ears.

Hereinafter, the first catching part 30 and the second catching part 50 will be described in order.

Referring to FIG. 16, the first catching part 30 may include the first hanger body 31 forming the body. In the present embodiment, the first hanger body 31 may be formed in a ring shape having a closed curve. The first cleaner body 21 may be mounted on one side of the first hanger body 31, and may be fixed to the user's ear on the other side of the first hanger body 31. The first cleaner body 21 may be located inside one side of the first hanger body 31, and the user's ear may be located inside the other side of the first hanger body 31. A part of the first hanger body 31 may be in contact with the first cleaner body 21. A portion of the first hanger body 31 may be in contact with the first side surface 21*a*, the second side surface 21*b*, and the third side surface 21*c* of the first cleaner body 21.

The first hanger body 31 may include a first body 31*a*, a second body 31*b*, a third body 31*c*, and a fourth body 31*d*. The first hanger body 31 may be formed by connecting the first to the fourth body. The first body 31*a* may be a part disposed between the first air cleaner 20 and the first fixing part 13. The fourth body 31*d* may be a part which is fixed to the user's ear. The second body 31*b* and the third body 31*c* may be parts connecting the first body 31*a* and the fourth body 31*d*.

The first hanger body 31 may include a first duct through hole 311. The first duct through hole 311 may be disposed in the first body 31*a* of the first hanger body 31. The first duct 211 of the first cleaner body 21 may pass through the first duct through hole 311. The first duct through hole 311 may be an opening into which the first protrusion 210 of the first cleaner body 21 is inserted and fixed. The first duct through hole 311 may be formed to correspond to the first protrusion 210. The first duct 211 may be inserted into the first duct insertion hole 131 with the first protrusion 210 being inserted into the first duct through hole 311.

The first body 31*a* of the first hanger body 31 may have one surface in contact with the first cleaner body 21 and the other surface in contact with the first fixing body 130. The first body 31*a* of the first hanger body 31 may be interposed between the first cleaner body 21 and the first fixing body 130 to perform a packing function. The first hanger body 31 may be interposed between the first cleaner body 21 and the first fixing body 130 to support the left end of the mask body 10. The first protrusion 210 may be inserted into and fixed to the first duct through hole 311. In the present embodiment, the first duct through hole 311 may be referred to as the first protrusion part insertion hole to which the first protrusion 210 is inserted and fixed.

The first hanger body 31 may include a first wire tube through hole 312. The first wire tube through hole 312 may be disposed in the first body 31*a* of the first hanger body 31. The first wire tube through hole 312 may be an opening through which the first wire tube 213 of the first cleaner body 21 passes. The first wire tube through hole 312 may be formed to correspond to the first wire tube 213. The first wire tube 213 may be inserted into the first wire tube insertion hole 131 while the first wire tube 213 is being inserted into the first wire tube through hole 312. The first hanger body 31 may be interposed between the first cleaner body 21 and the first fixing body 130 to support a left end of the mask body 10.

The first hanger body 31 may include a first through hole 318. The first through hole 318 may be an opening through which the first separation preventing strap 281 of the first separation preventing part 28 passes. The first through hole 318 may be formed to correspond to the first separation prevention strap 281. The first through hole 318 may be disposed in the first body 31*a* of the first hanger body 31. The first through hole 318 may be disposed at one side of the first duct through hole 311, and the first wire tube insertion hole 132 may be disposed at the other side of the first duct through hole 311.

The first hanger body 31 may include a first handle 314. The first handle 314 may be located on the fourth body 31*d* of the first hanger body 31. The first handle 314 may be formed by protruding a portion of the first hanger body 31 outward. The fourth body 31*d* of the first hanger body 31 may include one surface facing the user's ear and the other surface facing the outside. The first handle 314 may protrude outward from the other surface of the fourth body 31*d*. The first handle 314 may be a part that the user grabs when the first hanger body 31 is mounted on the user's ear.

The first hanger body 31 may include a first hook groove 317. The first hook groove 317 may be provided in plurality. The first locking hook 217 of the first cleaner body 21 may be locked into the first hook groove 317. The first hook groove 317 may be disposed at a position corresponding to the first locking hook 217. The first hook groove 317 may be disposed at the second body 31*b* and the third body 31*c* of the first hanger body 31. The first hook groove 317 may be formed by recessing a portion of the first hanger body 31 so that the first locking hook 217 may be inserted therein. In detail, the second body 31*b* and the third body 31*c* may be defined as an inner surface and an outer surface. The first hook groove 317 may be formed by recessing the inner surfaces of the second body 31*b* and the third body 31*c* toward the outer surface. The first hook groove 317 may be recessed in a shape corresponding to a bent portion so that the bent portion of the first locking hook 217 may be inserted and locked. That is, the first hook groove 317 may be opened to a shape corresponding to the first locking hook 217 so that the first locking hook 217 may be fitted and locked.

The first catching part 30 may include a first contact part 32. The first contact part 32 may be provided on an inner surface of the first hanger body 31. The inner surface of the first hanger body 31 may be a surface in contact with the user's ear. The first contact part 32 may be disposed on the fourth body 31*d* of the first catching part 30. The first contact part 32 may further extend from the fourth body 31*d* of the first catching part 30 toward at least one of the second body 31*b* and the third body 31*c*. The first contact part 32 may be disposed between the user's ear and the first catching part 30 to distribute a pressure applied to the user's ear. The first contact part 32 may be made with a material having a predetermined elastic force to distribute the pressure applied to the user's ear.

In one embodiment, the first contact part 32 may further include a sensor for obtaining biometric information from a user's ear. The sensor may be provided inside the first contact part 32 and may contact the user's ear to obtain biometric information. For example, the operation of the mask device 1 may be controlled by the controller based on the biometric information obtained through the sensor.

The first hanger body 31 may include a first recessed part 319. The first recessed part 319 may be formed by recessing a portion of the first hanger body 31. Yin FIG. 16 is a cross-sectional view showing a part of the first hanger body 31. Referring to Y of FIG. 16, the first recessed part 319 may be formed by recessing an outer surface of the first hanger body 31 toward an inner surface. The first recessed part 319 may be disposed at the second body 31*b* and the fourth body 31*d* of the first hanger body 31. The first recessed part 319 may be a space in which the glasses legs of the glasses may be seated when the glasses are worn after the first catching part 30 is attached to the user's ear.

Referring to FIG. 17, the second catching part 50 may include a second hanger body 51 forming a body. In the present embodiment, the second hanger body 51 may be formed in a ring shape having a closed curve. The second cleaner body 41 may be mounted on one side of the second hanger body 51, and may be fixed to the user's ear on the other side of the second hanger body 51. The second cleaner body 41 may be located inside one side of the second hanger body 51, and the user's ear may be located inside the other side of the second hanger body 51. A part of the second hanger body 51 may be in contact with the second cleaner body 41. A part of the second hanger body 51 may be in contact with the first side surface 41*a*, the second side surface 41*b*, and the third side surface 41*c* of the second cleaner body 41.

The second hanger body 51 may include a first body 51*a*, a second body 51*b*, a third body 51*c*, and a fourth body 51*d*. The second hanger body 51 may be formed by connecting the first to the fourth body. The first body 51*a* may be a part disposed between the second air cleaner 40 and the second fixing part 14. The fourth body 51*d* may be a part which is fixed to the user's ear. The second body 51*b* and the third body 51*c* may be parts connecting the first body 51*a* and the fourth body 51*d*.

The second hanger body 51 may include a second duct through hole 511. The second duct through hole 511 may be disposed in the first body 51*a* of the second hanger body 51. The second duct 411 of the second cleaner body 41 may pass through the second duct through hole 511. The second duct through hole 511 may be an opening into which the second protrusion 410 of the second cleaner body 41 is inserted and fixed. The second duct through hole 511 may be formed to correspond to the second protrusion 410. The second duct 411 may be inserted into the second duct insertion hole 141 while the second protrusion 410 is being inserted into the second duct through hole 511.

The first body 51*a* of the second hanger body 51 may have one surface in contact with the second cleaner body 41 and the other surface in contact with the second fixing body 140. The first body 51*a* of the second hanger body 51 may be interposed between the second cleaner body 41 and the second fixing body 140 to perform a packing function. The second hanger body 51 may be interposed between the second cleaner body 41 and the second fixing body 140 to support the right end of the mask body 10. The second protrusion 410 may be inserted into and fixed to the second duct through hole 511. In the present embodiment, the second duct through hole 511 may be referred to as a second protrusion insertion hole to which the second protrusion 410 is inserted and fixed.

The second hanger body 51 may include a second wire tube through hole 512. The second wire tube through hole 512 may be disposed in the first body 51*a* of the second hanger body 51. The second wire tube through hole 512 may be an opening through which the second wire tube 413 of the second cleaner body 41 passes. The second wire through hole 512 may be formed to correspond to the second wire tube 413. The second wire tube 413 may be inserted into the second wire tube insertion hole 141 while the second wire tube 413 is being inserted into the second wire tube through hole 512. The second hanger body 51 may be interposed between the second cleaner body 41 and the second fixing body 140 to support the right end of the mask body 10.

The second hanger body 51 may include a second through hole 518. The second through hole 518 may be an opening through which the second separation preventing strap 481 of the second separation preventing part 48 passes. The second through hole 518 may be formed to correspond to the second separation prevention strap 481. The second through hole 518 may be disposed in the second body 51*a* of the second hanger body 51. The second through hole 518 may be disposed on one side of the second duct through hole 511, and the second wire tube insertion hole 142 may be disposed on the other side of the second duct through hole 511.

The second hanger body 51 may include a second handle 514. The second handle 514 may be located on the fourth body 51*d* of the second hanger body 51. The second handle 514 may be formed by protruding a portion of the second hook body 51 outward. The fourth body 51*d* of the second hanger body 51 may include one surface facing the user's ear and the other surface facing the outside. The second handle 514 may protrude outward from the other surface of the fourth body 51*d*. The second handle 514 may be a part that the user grabs when the second hanger body 51 is mounted on the user's ear.

The second hanger body 51 may include a second hook groove 517. The second hook groove 517 may be provided in plurality. The second locking hook 417 of the second cleaner body 41 may be locked to the second hook groove 517. The second hook groove 517 may be disposed at a position corresponding to the second locking hook 417. The second hook groove 517 may be disposed at the second body 51*b* and the third body 51*c* of the second hanger body 51. The second hook groove 517 may be formed by recessing a portion of the second hanger body 51 so that the second locking hook 417 may be inserted therein. In detail, the second body 51*b* and the third body 51*c* may be defined as an inner surface and an outer surface. The second hook groove 517 may be formed by recessing the inner surfaces of the second body 51*b* and the third body 51*c* toward the outer surface. The second hook groove 517 may be recessed in a shape corresponding to a bent portion so that the bent portion of the second locking hook 417 may be inserted and locked. That is, the second hook groove 517 may be opened to a shape corresponding to the second locking hook 417 so that the second locking hook 417 may be fitted and locked.

The second catching part 50 may include a second contact part 52. The second contact part 52 may be provided on an inner surface of the second hanger body 51. The inner surface of the second hanger body 51 may be a surface in contact with the user's ear. The second contact part 52 may be disposed on the fourth body 51*d* of the second catching part 50. The second contact part 52 may further extend from the fourth body 51*d* of the second catching part 50 toward at least one of the second body 51*b* and the third body 51*c*. The second contact part 52 may be disposed between the user's ear and the second catching part 50 to distribute a pressure applied to the user's ear. The second contact part 52 may be made with a material having a predetermined elastic force to distribute the pressure applied to the user's ear.

In one embodiment, the second contact part 52 may further include a sensor for obtaining biometric information from the user's ear. The sensor may be provided inside the second contact part 52 and may contact the user's ear to obtain biometric information. For example, the operation of the mask device 1 may be controlled based on the biometric information obtained through the sensor.

The second hanger body 51 may include a second recessed portion 519. The second recessed part 519 may be formed by recessing a portion of the second hanger body 51. Z in FIG. 17 is a cross-sectional view showing a part of the second hanger body 51. Referring to Z of FIG. 17, the second recess 519 may be formed by recessing an outer surface of the second hanger body 51 toward an inner surface. The second recessed part 519 may be disposed at the second body 51*b* and the fourth body 51*d* of the second hanger body 51. The second recessed part 519 may be a space in which the glasses legs of the glasses may be seated when the glasses are worn after the second catching part 50 is mounted on the user's ear.

Figure 18:
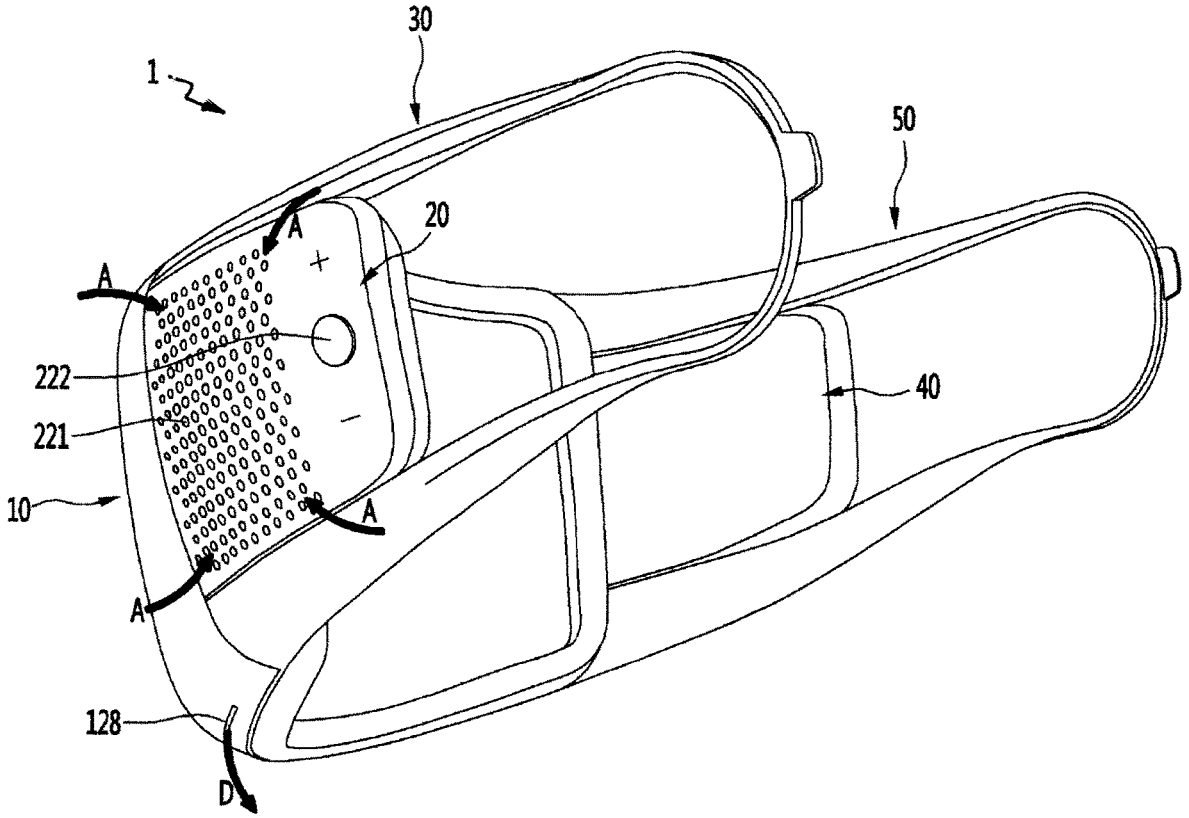
FIGS. 18 and 19 are views showing an air flow flowing in the mask device according to the first embodiment of the present invention.
Figure 19:
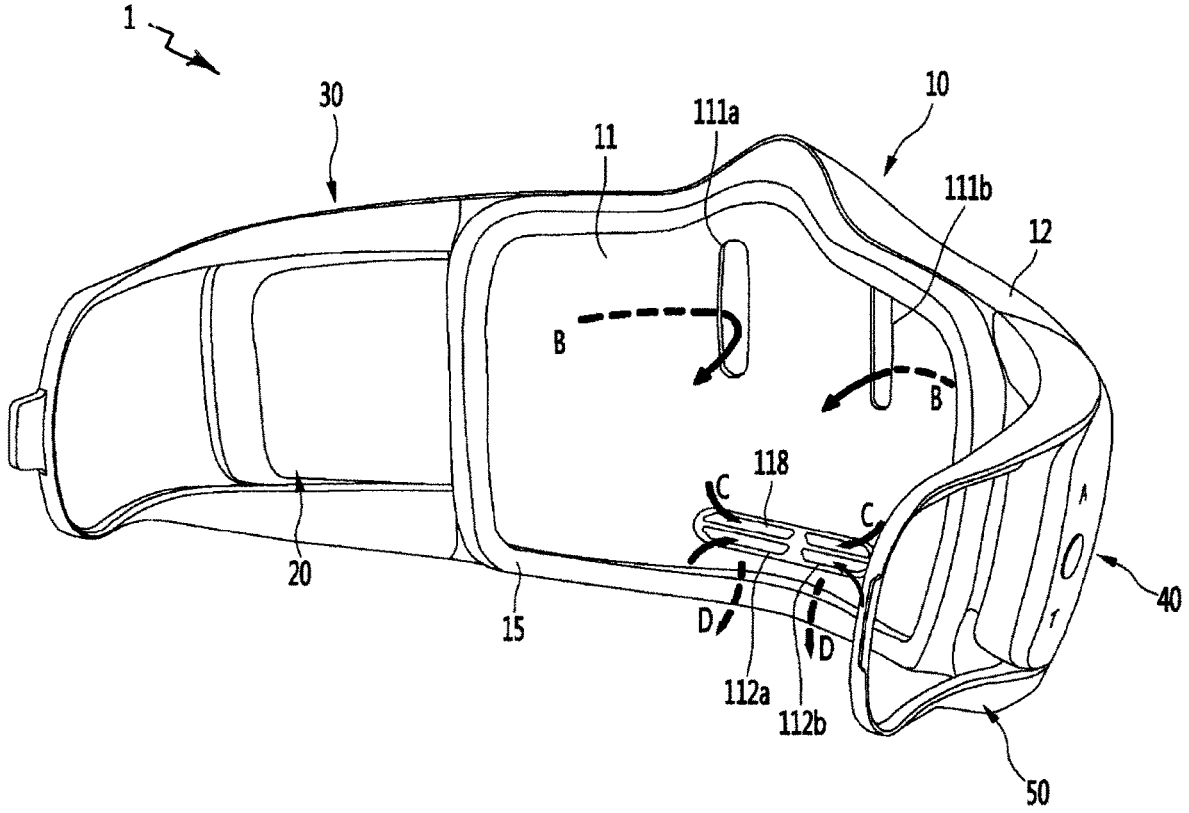

FIGS. 18 and 19 are views showing an air flow flowing in the mask device according to the first embodiment of the present invention.

Referring to FIGS. 18 and 19, the mask device 1 according to the embodiment may be in close contact with the user's face while covering the user's nose and mouth. The mask device 1 may be supported by the user's ears by the first catching part 30 and the second catching part 50 while the packing is in contact with the user's face. The user may operate the mask device 1 by turning on/off at least one of the first switch 222 and the second switch 422 while the mask device 1 is in close contact with the user's face. Although the mask device 1 is described as being mounted on the user's nose and mouth, the mask device 1 may also be mounted on a pet. In this case, the mask device 1 may be configured to be mounted on the head of the pet.

When the mask device 1 is operated, the first fan module 24 and the second fan module 44 may be operated to suck in outside air. The first fan module 24 and the second fan module 44 may be operated to suck in outside air into the first suction opening 221 and the second suction opening 421. A flow direction of the outside air introduced through the first suction opening 221 and the second suction opening 421 is indicated by A in FIG. 18. The first air cleaner 20 may suck in outside air at the left side of the user's face, and the second air cleaner 40 may suck in outside air at the right side of the user's face.

The outside air sucked into the first suction opening 221 may be filtered by the first filter module 25, and the outside air sucked into the second suction opening 421 may be filtered by the second filter module 45. The filtered air may be discharged to the inlet 111*a* and 111*b* of the mask body 10 after passing through the first flow passage 124*a* and the second flow passage 124*b*. The air flowing through the first flow passage 124*a* and the second flow passage 124*b* and discharged to the inlet 111*a* and 111*b* is represented by B in FIG. 19. The air filtered by the first air cleaner 30 may be supplied through the first inlet 111*a*, and the air filtered by the second air cleaner 40 may be supplied through the second inlet 111*b*. The air discharged to the inlet 111*a* and 111*b* is supplied to the user's nose and mouth, and the user may inhale in the filtered air. Since the filtered air is forced to flow by the first fan module 24 and the second fan module 44, filtered air may be abundantly supplied to the breathing space of the mask body 10.

Air exhaled from the user's nose and mouth may flow into the outlet 112*a* and 112*b* of the mask body 10. Because the filtered air is continuously being supplied through the inlet 111*a* and 111*b* in the upper space of the breathing space of the mask body 10, the exhaled air may flow in the lower space in the direction toward the outlet 112*a* and 112*b*. Since the outlet 112*a* and 112*b* is located in front of the user's mouth, the exhaled air may be discharged through the outlet 112*a* and 112*b* quickly. The air discharged through the outlet 112*a* and 112*b* may flow into the third passage 124*c* of the mask body 10. The flow direction of air exhaled from the user's nose and mouth is indicated by C in FIG. 19. The third passage 124*c* may be separated from the first passage 124*a* and the second passage 124*b* to prevent mixing of the filtered air and the discharged air.

The discharge port 128*a* and 128*b* may discharge the discharged air from the user's nose and mouth from the third flow passage 124*c* to the outside environment. The discharged air from the third flow passage 124*c* passes through the discharge port 128*a* and 128*b* and is discharged to the outside, and the flow direction of the air is represented by D in FIG. 19. In the present embodiment, since the discharge port 128*a* and 128*b* is located at the lower portion of the mask body 1, the air discharged to the outside may be prevented from entering back into the first air cleaner 20 and the second air cleaner 40.

At least one of the discharge port 128*a* and 128*b* and the outlet 112*a* and 112*b* may be provided with a check valve 118. In this embodiment, the check valve 118 may be provided to the outlet 112*a* and 112*b*. The check valve 118 may prevent backflow of discharged air back into at least one of the outlet 128*a* and 128*b* and the outlet 112*a* and 112*b*. The check valve 118 may be closed when the user inhales the filtered air and may be open when the user exhales the air to be discharged.

Figure 20:
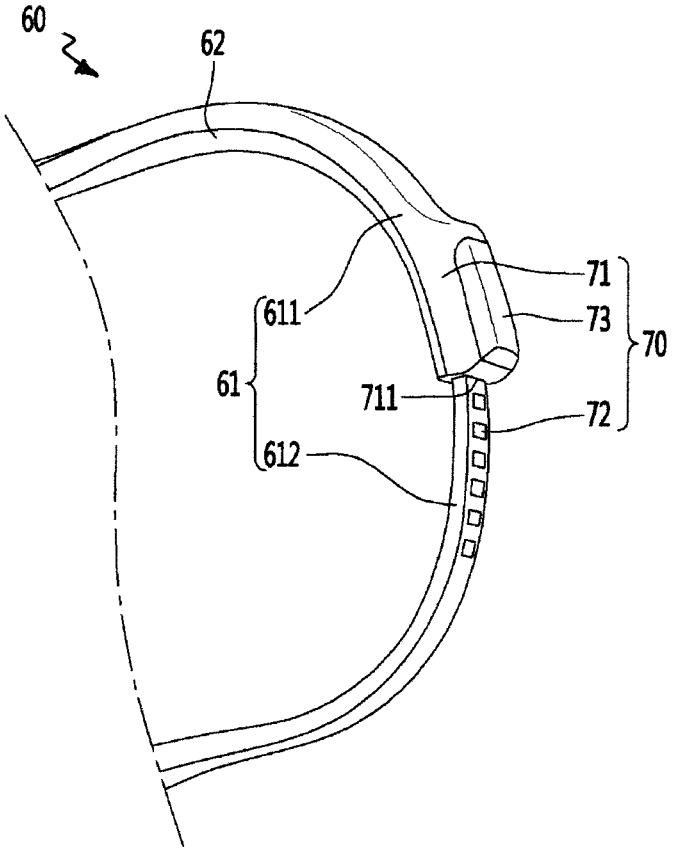
FIG. 20 is a view showing a locking portion of the mask device according to a second embodiment of the present invention.

FIG. 20 is a view showing a locking portion of a mask device according to a second embodiment of the present invention.

Some parts of the mask device according to the second embodiment of the present invention may be the same or similar as the mask device 1 according to the first embodiment. Therefore, parts being the same or similar as in the mask device 1 may be omitted from the description of the mask device 2 according to the second embodiment. Hereinafter, a specific part of the mask device 2 according to the second embodiment modified from the mask device 1 according to the first embodiment will be described.

The mask device 2 according to the embodiment may include a third catching part and a fourth catching part. The third catching part may be coupled to the first air cleaner 20, and the fourth catching part may be coupled to the second air cleaner 40. The third catching part and the fourth catching part may be in different positions of the mask device 2, that is left and right side of the mask device 2, but the configuration may be the same. Therefore, the third catching part and the fourth catching part will be described as the catching part 60.

Referring to FIG. 20, the catching part 60 may include a hanger body 61 forming a body. An air cleaner may be coupled to one side of the hanger body 61, and the user's ear may be fixed to the other side of the hanger body 61.

The hanger body 61 may include an upper hanger 611 and a lower hanger 612. One side of the upper hanger 611 and the lower hanger 612 may be connected to the air cleaner. The other side of the upper hanger 611 and the lower hanger 612 may be detachably coupled to each other. The upper hanger 611 may be a part located above the user's ear, and the lower hanger 612 may be a part located below the user's ear.

The hanger body 61 may include a contact part 62. The contact part 62 may be provided on at least one of the upper hanger 611 and the lower hanger 612. The contact part 62 may intervene between at least one of the upper hanger 611 and the lower hanger 612 and the user's ear to distribute the pressure applied to the user's ear. The contact part 62 may be made of a material that may be easily deformed and has elasticity to disperse the pressure applied to the user's ear.

The hanger body 61 may include a length adjusting part 70. The length adjusting part 70 may adjust the length of the hanger body 61 fixed to the user's ear. The length adjusting part 70 may be used to adjust the length of the hanger body 61 so that the mask body 10 may be in close contact with the user's face. The length adjusting part 70 may be adjusted to correspond to various users having faces of different sizes. In the present embodiment, the length adjusting part 70 may adjust the length of the hanger body 61 by adjustably inserting the other end of the lower hanger 612 into the other end of the upper hanger 611.

The length adjusting part 70 may include a lower hanger insertion part 71. The lower hanger insertion part 71 may be disposed at the other end of the upper hanger 611. The lower hanger insertion part 71 and the upper hanger 611 may have a diameter or size larger than that of the lower hanger 612 so that the lower hanger 612 may be inserted into the lower hanger insertion part 71 of the length adjusting part 70. The lower hanger 612 may move into the upper hanger 611 after being inserted into the lower hanger insertion part 71. Although the lower hanger 612 is described as being inserted into the lower hanger insertion portion 71, the configuration may be reversed and upper hanger 611 may be inserted into the lower hanger 612. Although referred to as the lower hanger insertion portion 71, in this embodiment, it may be referred to as a buckle for adjusting the insertion length of the lower hanger 612.

The lower hanger insertion part 71 may include a lower hanger insertion hole 711. The lower hanger insertion hole 711 may be an opening into which the lower hanger 612 may be inserted. The lower hanger insertion hole 711 may be formed to correspond to the lower hanger 612. The lower hanger insertion hole 711 may extend from the lower hanger insertion part 71 to the inside of the upper hanger 611. The lower hanger 612 inserted into the lower hanger insertion hole 711 may be inserted up to the inside of the upper hanger 611.

A guide groove 72 may be provided on one surface of the lower hanger 612. A plurality of guide grooves 72 may be inserted into the lower hanger insertion part 71 together with the lower hanger 612. The plurality of guide grooves 72 may limit separation of the lower hanger 612 from the lower hanger insertion part 71. The plurality of guide grooves 72 inserted into the lower hanger insertion part 71 may lock onto a protrusion provided in the lower hanger insertion part 71. Thus, the user may adjust the length of the hanger body 61 by using a method in which the protrusion of the lower hanger insertion part 71 is fixed to the plurality of guide grooves 72 inserted into the lower hanger insertion part 71. In the present embodiment, the plurality of guide grooves may be referred to as racks.

The length adjusting part 70 may include an adjusting switch 73. The adjusting switch 73 may be provided on one side of the lower hanger insertion part 71. The adjusting switch 73 may adjust whether the protrusion provided inside the lower hanger insertion part 71 is fixed to the plurality of guide grooves 72. For example, when the adjusting switch 73 is operated, the protrusion fixed to any one of the guide grooves of the plurality of guide grooves 72 may be released. When the protrusion is released from the plurality of guide grooves 72, the lower hanger 612 may be separated from the lower hanger insertion part 71. The user may manipulate the adjusting switch 73 to separate the protrusion fixed to any one of the guide grooves 72 of the plurality of guide grooves 72, thereby adjusting the length of the hanger body 61.

When the length adjusting part 70 is provided to the catching part 60, the length of the hanger body 61 may be freely adjusted. The mask device 2 may be in close contact with various faces of users by adjusting the length of the hanger body 61. The upper hanger 611 may be extended or shortened from the lower hanger 612, so that the mask device 2 may be easily worn on the user's ear.

Figure 21:
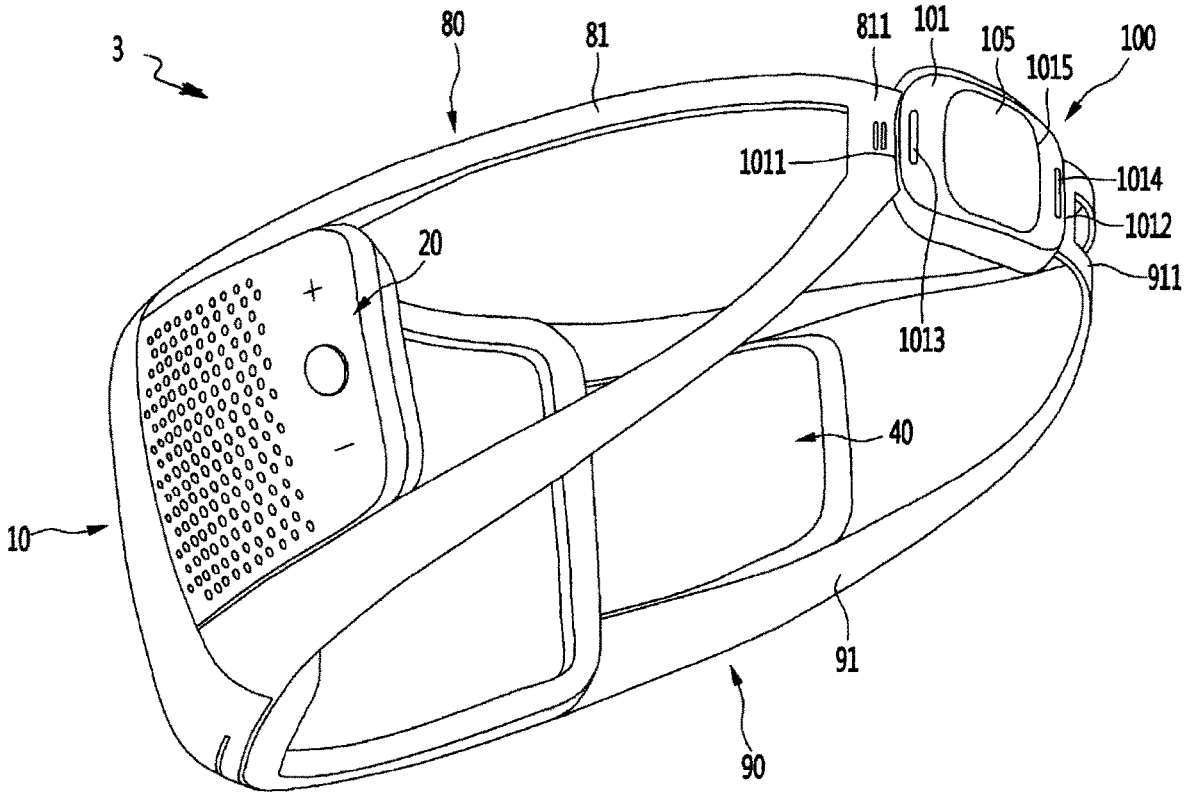
FIG. 21 is a view showing a mask device according to a third embodiment of the present invention.

FIG. 21 is a view showing a mask device according to a third embodiment of the present invention.

Some parts of the mask device according to the third embodiment of the present invention may be the same or similar as the mask device 1 according to the first embodiment. Therefore, parts being the same or similar as in the mask device 1 may be omitted from the description of the mask device 3 according to the third embodiment. Hereinafter, a specific part of the mask device 3 according to the third embodiment modified from the mask device 1 according to the first embodiment will be described.

Referring to FIG. 21, the mask device 3 according to the third embodiment of the present invention may include a mask body 10, a first air cleaner 20, and a second air cleaner 40. The mask device 3 may include a fifth catching part 80 coupled to the first air cleaner 20, and a sixth catching part 90 coupled to the second air cleaner 40. The mask device 3 may include a coupling module 100 coupling the fifth catching part 80 and the sixth catching part 90 to each other. In the present embodiment, the fifth catching part 80, the sixth catching part 90, and the coupling module 100 may allow the mask body 10 to be supported by the user's head. Alternatively, the fifth catching part 80, the sixth catching part 90, and the coupling module 100 may allow the mask body 10 to be supported on a hat, a helmet, or the like on the user's head.

The fifth catching part 80 may include a fifth hanger body 81 forming a body. The first air cleaner 20 may be detachably mounted to the fifth hanger body 81. One side of the fifth hanger body 81 may be coupled to the first air cleaner 20. The other side of the fifth hanger body 81 may be coupled to the coupling module 100. The fifth hanger body 81 may be formed in a ring or ring shape. The user's ear may be positioned inside the fifth hanger body 81 or the user's ear may not be positioned inside the fifth hanger body 81. The fifth hanger body 81 may include a duct through hole, a through hole, a wire tube through hole, and a hook groove for mounting the first air cleaner 20, which has been described in the first embodiment.

The other side of the fifth hanger body 81 may include a first connector 811. The first connector 811 may be for coupling the fifth hanger body 81 to one side of the coupling module 100. The first connector 811 may be detachably fixed to one side of the coupling module 100. For example, one side of the coupling module 100 may be configured such that the first connector 811 is inserted and fixed thereto. The distance between the coupling module 100 and the mask body 10 may be adjusted by the insertion length of the first connector 811 inserted into one side of the coupling module 100. In other words, the length of the fifth hanger body 81 may be adjusted in the longitudinal direction by the insertion length of the first connector 811 inserted into one side of the coupling module 100. When the length of the fifth hanger body 81 is adjusted, the mask body 10 may be stably fixed to the user's head, helmet, hat, and the like.

The sixth catching part 90 may include a sixth hanger body 91 forming a body. The second air cleaner 40 may be detachably mounted to the sixth hanger body 91. One side of the sixth hanger body 91 may be coupled to the second air cleaner 40. The other side of the sixth hanger body 91 may be coupled to the coupling module 100. The sixth hanger body 91 may be formed in a ring or ring shape. The user's ear may be positioned inside the sixth hanger body 91 or the user's ear may not be positioned inside the sixth hanger body 91. The sixth hanger body 91 may include a duct through hole, a through hole, a wire tube through hole, and a hook groove for mounting the second air cleaner 40.

The other side of the sixth hanger body 91 may include a second connector 911. The second connector 911 may be coupling the sixth hanger body 91 to the other side of the coupling module 100. The second connector 911 may be detachably fixed to the other side of the coupling module 100. For example, the other side of the coupling module 100 may be configured such that the second connector 911 is inserted and fixed thereto. The distance between the coupling module 100 and the mask body 10 may be adjusted by an insertion length in which the second connector 911 is inserted into the other side of the coupling module 100. In other words, the length of the sixth hanger body 91 may be adjusted in the longitudinal direction by the insertion length of the second connector 911 inserted into the other side of the coupling module 100. When the length of the sixth hanger body 91 is adjusted, the mask body 10 may be stably fixed to the user's head, helmet, hat, and the like.

The coupling module 100 may include a coupling module body 101 forming a body. The coupling module 100 may couple one end of the fifth hanger body 81 and one end of the sixth hanger body 91.

The coupling module body 101 may include a first connector inserting part 1011 into which the first connector 811 is inserted and a second connector inserting part 1012 into which the second connector 911 is inserted. The first connector inserting part 1011 may be disposed at one side of the coupling module body 101, and the second connector inserting part 1012 may be disposed at the other side of the coupling module body 101. The first connector 811 may be inserted into and fixed to the first connector inserting part 1011, and the second connector 911 may be inserted into and fixed to the second connector inserting part 1012.

The coupling module body 101 may include a first adjusting part 1013 and a second adjusting part 1014. The first adjusting part 1013 may be a button for separating the first connector 811 inserted into and fixed to the first connector insertion part 1011. The second adjusting part 1014 may be a button for separating the second connector 911 inserted into the second connector inserting part 1012 and fixed thereto. The first connector 811 and the second connector 911 may be fixed to the user's face according to the length being inserted into the first connector insertion part 1011 and the second connector insertion part 1012 through which the length may be adjusted.

The coupling module body 101 may include an auxiliary battery 105. The auxiliary battery 105 may supply power to at least one of the first air cleaner 20 and the second air cleaner 40. The auxiliary battery 105 may be detachably coupled to the coupling module body 101. The coupling module body 101 may include a battery mounting groove 1015 in which the auxiliary battery 105 is mounted.

The battery mounting groove 1015 may be formed to correspond to a shape of the auxiliary battery 105. The battery mounting groove 1015 may be formed by recessing a portion of the coupling module body 101. The auxiliary battery 105 may be mounted in the battery mounting groove 1015 and mounted on the coupling module body 101.

The coupling module body 101 may supply power of the auxiliary battery 105 to at least one of the first connector 811 and the second connector 911. For example, at least one of the first connector 811 and the second connector 911 and the coupling module body 101 may be configured as a socket. When at least one of the first connector 811 and the second connector 911 is coupled to the coupling module body 101, it may be electrically connected. Inside the fifth hanger body 81 and the sixth hanger body 91 are provided electrical wires for transmitting the power of the auxiliary battery 105 to the first air cleaner 20 and the second air cleaner 40.

When the auxiliary battery 105 is mounted on the coupling module 100, power may be additionally supplied to the mask device 3. The operation time of the mask device 3 may be extended by the auxiliary battery 105. Since the auxiliary battery 105 is disposed on the coupling module 100 which may be centered in the mask device 3, the auxiliary battery 105 may not cause the weight of the mask device 3 from being unevenly balanced. In one embodiment, the battery 26 of the mask device 3 may be charged by using the auxiliary battery 105 or by consuming the power of the auxiliary battery 105.

While preferred embodiments of the present invention have been described above with reference to the drawings, the present invention is not limited to the above-described embodiments, and it will be apparent to those skilled in the art that the embodiments of the present invention may be modified without departing from the spirit and scope of the present invention. It will be understood that modifications and variations are possible. Therefore, the scope of the present invention should not be defined by the described embodiments, but should be determined by the technical spirit described in the claims.

What is claimed is:

1. A mask device comprising:

a mask body provided with at least one inlet and at least one outlet located below the inlet;

a first air cleaner and a second air cleaner for filtering outside air sucked in from an outside environment and supplying the filtered air through the mask body to the at least one inlet, the first air cleaner coupled to a first side of the mask body and the second air cleaner coupled to a second side of the mask body; and a first fixing part and a second fixing part, the first fixing part for coupling the first air cleaner to the mask body and the second fixing part for coupling the second air cleaner to the mask body, wherein the first air cleaner and the second air cleaner each including:

a cleaner body including an air flow space and an accommodation space, the air flow space and the accommodation space are formed to be divided from each other inside the cleaner body by a divider, an internal surface of the divider defines three sides of the respective air flow space and an external surface of the divider defines three sides of the respective accommodation space;

a cleaner cover combined with the respective cleaner body and includes a suction opening;

a fan module that is disposed in the respective air flow space; and a filter module that is disposed in the respective air flow space, wherein the fan module of the first air cleaner and the second air cleaner suck in the outside air through the respective suction opening, and the filter module of the first air cleaner and the second air cleaner filter the sucked in outside air through the respective suction opening, wherein the accommodation space of the first cleaner includes a space having a battery, and the accommodation space of the second cleaner includes a space having a circuit board, and wherein a flow path entering the respective fan module is substantially orthogonal to an air flow path exiting the respective fan module.

2. The mask device of claim 1, further comprising a first duct and a second duct, wherein the first duct channels the filtered air in the air flow space of the first air cleaner to the mask body; and the second duct channels the filtered air in the air flow space of the second air cleaner to the mask body.

3. The mask device of claim 2, wherein the at least one inlet comprises a first inlet and a second inlet;

the mask body comprises a first flow passage and a second flow passage, wherein the first flow passage couples the first duct to the first inlet, and the second flow passage couples the second duct to the second inlet.

4. The mask device of claim 2, wherein the first air cleaner includes the first duct;

the second air cleaner includes the second duct;

the first fixing part includes a first duct insertion hole for detachably receiving the first duct of the first air cleaner; and The second fixing part includes a second duct insertion hole for detachably receiving the second duct of the second air cleaner.

5. The mask device of claim 4, wherein the first air cleaner and the second air cleaner are foldable with respect to the mask body, the first air cleaner and the second air cleaner folds to a breathing space of the mask body corresponding to a space where a user's nose and mouth are positioned.

6. The mask device of claim 4, further comprising a first separation preventing part coupled to the first air cleaner and the first fixing part; and a second separation preventing part coupled to the second air cleaner and the second fixing part.

7. The mask device of claim 4, further comprising a first catching part coupled to the first air cleaner for coupling to a user's ear; and a second catching part coupled to the second air cleaner for coupling to the user's another ear.

8. The mask device of claim 7, wherein a part of the first catching part includes a first duct through hole in which the first duct of the first air cleaner is disposed;

a part of the second catching part includes a second duct through hole in which the second duct of the second air cleaner is disposed; and the part of the first catching part is disposed between the first air cleaner and the first fixing part and the part of the second catching part is disposed between the second air cleaner and the second fixing part when the first and second air cleaner are fixed to the respective first fixing part and second fixing part.

9. The mask device of claim 7, wherein the first catching part and the second catching part each includes a contact part made with a material having an elasticity disposed at a part of the first catching part and the second catching part for making contact with a user's respective ears.

10. The mask device of claim 7, wherein the first catching part and the second catching part each includes a groove disposed at a part of the first catching part and the second catching part for receiving respective leg of an eye glass at the first catching part and the second catching part.

11. The mask device of claim 7, wherein the first catching part and the second catching part each includes a first hanger portion and a second hanger portion, a length adjusting part disposed at the first hanger portion including a hanger insertion part to receive the second hanger portion, wherein the length adjusting part adjustably receives the second hanger portion based on an adjustment of a user.

12. The mask device of claim 7, wherein the first catching part including a connecting part; and the second catching part coupled to a coupling module, wherein the connecting part of the first catching part couples to the coupling module.

13. The mask device of claim 3, wherein the mask body includes a frame including the at least one inlet and at least one outlet; and a front cover coupled to the frame and forming an outer appearance of the frame.

14. The mask device of claim 13, wherein the frame includes a recess at both end portions of the frame; and the front cover includes a recess at both end portions of the front cover, and the recess of the frame and the front cover at respective end portions form a fixing recess in which the first fixing part and the second fixing part are respectively coupled.

15. The mask device of claim 13, wherein the mask body includes a partition plate between the frame and the front cover, the partition plate forming an upper space and a lower space in the mask body;

the first flow passage and the second flow passage are disposed in the upper space of the mask body; and a third flow passage is disposed in the lower space of the mask body, the third flow passage coupled to the at least one outlet.

16. The mask device of claim 15, wherein the third flow passage includes at least one discharge port for discharging air in the third flow passage to the outside environment; and at least one check valve disposed on one of the at least one discharge port and the at least one outlet for preventing air of the outside environment from entering through one of the at least one discharge port and the at least one outlet.

17. The mask device of claim 15, further comprising a first inflow guide and a second inflow guide for dividing the upper space of the mask body into a space in which the first flow passage and the second flow passage are formed, and a space in which at least one component is disposed.

18. The mask device of claim 17, wherein the at least one component is at least one of a fragrance module or an ionizer.

* * * * *